US011446554B2

(12) United States Patent
Willett et al.

(10) Patent No.: US 11,446,554 B2
(45) Date of Patent: Sep. 20, 2022

(54) GOLF CLUB HEAD WITH VERTICAL CENTER OF GRAVITY ADJUSTMENT

(71) Applicant: Taylor Made Golf Company, Inc., Carlsbad, CA (US)

(72) Inventors: Kraig Alan Willett, Fallbrook, CA (US); Todd P. Beach, Encinitas, CA (US); Christopher John Harbert, Carlsbad, CA (US); Gery Mel Zimmerman, Fallbrook, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 17/183,057

(22) Filed: Feb. 23, 2021

(65) Prior Publication Data

US 2021/0170244 A1 Jun. 10, 2021

Related U.S. Application Data

(60) Continuation of application No. 17/095,479, filed on Nov. 11, 2020, now Pat. No. 11,278,777, which is a continuation of application No. 16/554,255, filed on Aug. 28, 2019, now Pat. No. 10,835,790, which is a continuation of application No. 16/024,459, filed on Jun. 29, 2018, now Pat. No. 10,441,859, which is a continuation of application No. 15/253,652, filed on (Continued)

(51) Int. Cl.

| | |
|---|---|
| ***A63B 53/04*** | (2015.01) |
| ***A63B 53/06*** | (2015.01) |
| ***A63B 60/00*** | (2015.01) |

(52) U.S. Cl.

CPC ..... *A63B 53/06* (2013.01); *A63B 53/0466* (2013.01); *A63B 60/00* (2015.10); *A63B 53/045* (2020.08); *A63B 53/0408* (2020.08); *A63B 53/0412* (2020.08); *A63B 53/0433* (2020.08); *A63B 53/0437* (2020.08); *A63B 53/0458* (2020.08); *A63B 2053/0491* (2013.01)

(58) Field of Classification Search

CPC .. A63B 53/0408; A63B 53/04; A63B 53/0433
USPC ..... 473/324–350
See application file for complete search history.

(56) References Cited

U.S. PATENT DOCUMENTS 1,133,129 A * 3/1915 Govan ..... A63B 53/0466 473/337
2,517,245 A * 8/1950 Scott ..... A63B 53/0466 473/339

(Continued)

FOREIGN PATENT DOCUMENTS

FR 2581320 A1 11/1986
FR 2581320 A1 * 11/1986

(Continued)

*Primary Examiner* — Alvin A Hunter
(74) *Attorney, Agent, or Firm* — Klarquist Sparkman, LLP

(57) ABSTRACT

Golf club heads include at least one weight port situated to retain weights and positioned above an approximate club face geometric center with the club in a standard address position. One, two, or more weight ports can be located above the club face center in a club crown or other portion of a club body. Club head vertical center of gravity can be selected to compensate dynamic loft associated with locating the club head center of gravity well behind the club face. Three-dimensional adjustment of club head center of gravity is possible.

20 Claims, 11 Drawing Sheets

Related U.S. Application Data

Aug. 31, 2016, now Pat. No. 10,035,054, which is a continuation of application No. 14/266,608, filed on Apr. 30, 2014, now Pat. No. 9,452,327, which is a continuation of application No. 14/069,249, filed on Oct. 31, 2013, now Pat. No. 8,900,072, which is a continuation of application No. 13/607,263, filed on Sep. 7, 2012, now Pat. No. 8,579,725, which is a continuation of application No. 12/834,549, filed on Jul. 12, 2010, now Pat. No. 8,262,507, which is a division of application No. 11/871,933, filed on Oct. 12, 2007, now Pat. No. 7,771,291.

(56) References Cited

U.S. PATENT DOCUMENTS 3,556,533 A * 1/1971 Hollis ..... A63B 53/0466 411/900
3,692,306 A * 9/1972 Glover ..... A63B 53/04 473/338
3,966,210 A * 6/1976 Rozmus ..... A63B 53/0487 473/341
3,979,123 A * 9/1976 Belmont ..... A63B 60/00 473/337
4,330,128 A * 5/1982 Morelli ..... A63B 53/0487 473/282
4,867,458 A * 9/1989 Sumikawa ..... A63B 53/047 473/336
4,869,507 A * 9/1989 Sahm ..... A63B 53/047 473/337
5,058,895 A * 10/1991 Igarashi ..... A63B 53/0487 473/341
D326,130 S * 5/1992 Chorne ..... D21/733
5,143,571 A * 9/1992 Lacoste ..... A63B 53/0466 264/263
5,186,465 A * 2/1993 Chorne ..... A63B 53/04 473/350
D354,782 S * 1/1995 Gonzalez, Jr. ..... D21/752
5,429,353 A * 7/1995 Hoeflich ..... A63B 60/00 473/291
5,447,309 A * 9/1995 Vincent ..... A63B 53/04 473/335
5,518,243 A * 5/1996 Redman ..... A63B 53/04 473/334
5,547,427 A * 8/1996 Rigal ..... A63B 53/04 473/345
5,620,379 A * 4/1997 Borys ..... A63B 60/00 473/340
5,629,475 A * 5/1997 Chastonay ..... A63B 53/0466 73/65.03
5,674,136 A * 10/1997 Gorse ..... A63B 60/00 473/328
5,851,160 A * 12/1998 Rugge ..... A63B 60/00 473/349
5,916,042 A * 6/1999 Reimers ..... A63B 53/04 473/345
5,935,020 A * 8/1999 Stites ..... A63B 60/00 473/345
5,947,840 A * 9/1999 Ryan ..... A63B 53/0466 473/335
D415,807 S * 10/1999 Werner ..... D21/733
6,012,989 A * 1/2000 Saksun, Sr. ..... A63B 53/04 473/305
6,048,278 A * 4/2000 Meyer ..... A63B 53/0466 473/345
6,074,310 A * 6/2000 Ota ..... A63B 60/00 473/345
6,123,627 A * 9/2000 Antonious ..... A63B 53/04 473/328
6,149,534 A * 11/2000 Peters ..... A63B 53/04 473/345
6,152,833 A * 11/2000 Werner ..... A63B 53/04 473/324
6,168,536 B1 * 1/2001 Lovett ..... A63B 53/0466 473/328
6,290,609 B1 * 9/2001 Takeda ..... A63B 53/047 473/335
6,319,148 B1 * 11/2001 Tom ..... A63B 53/04 473/331
6,398,666 B1 * 6/2002 Evans ..... A63B 53/04 473/345
6,494,790 B1 * 12/2002 Toyota ..... A63B 53/0466 473/345
6,524,194 B2 * 2/2003 McCabe ..... A63B 60/00 473/305
6,572,489 B2 * 6/2003 Miyamoto ..... A63B 53/0466 473/290
6,648,773 B1 * 11/2003 Evans ..... A63B 53/0466 473/345
6,695,712 B1 * 2/2004 Iwata ..... A63B 53/04 473/345
D489,105 S * 4/2004 Kim ..... D21/733
6,773,360 B2 * 8/2004 Willett ..... A63B 60/02 473/409
6,939,247 B1 * 9/2005 Schweigert ..... A63B 60/42 473/345
6,969,326 B2 * 11/2005 De Shiell ..... A63B 53/0466 273/DIG. 7
6,991,558 B2 * 1/2006 Beach ..... A63B 60/00 473/324
7,070,512 B2 * 7/2006 Nishio ..... A63B 53/0466 473/319
7,156,750 B2 * 1/2007 Nishitani ..... A63B 53/0466 473/345
7,163,468 B2 * 1/2007 Gibbs ..... A63B 53/02 473/335
7,166,038 B2 * 1/2007 Williams ..... A63B 53/02 473/345
7,186,185 B2 * 3/2007 Nagy ..... A63B 60/02 473/238
7,186,190 B1 * 3/2007 Beach ..... A63B 53/0466 473/335
7,198,575 B2 * 4/2007 Beach ..... A63B 53/0466 473/324
7,255,653 B2 * 8/2007 Saso ..... A63B 53/0466 473/345
7,278,927 B2 * 10/2007 Gibbs ..... A63B 60/00 473/335
7,351,161 B2 * 4/2008 Beach ..... A63B 53/0466 473/336
7,407,448 B2 * 8/2008 Stevens ..... A63B 53/0466 473/335
7,410,428 B1 * 8/2008 Dawson ..... A63B 60/00 473/345
7,413,520 B1 * 8/2008 Hocknell ..... A63B 53/0466 473/345
7,448,963 B2 * 11/2008 Beach ..... A63B 53/0466 473/337
7,497,789 B2 * 3/2009 Burnett ..... A63B 53/0466 473/345
7,510,485 B2 * 3/2009 Yamamoto ..... A63B 53/0466 473/348
7,530,904 B2 * 5/2009 Beach ..... A63B 60/00 473/345
7,549,935 B2 * 6/2009 Foster ..... A63B 60/00 473/335
7,568,985 B2 * 8/2009 Beach ..... A63B 53/06 473/336
7,578,753 B2 * 8/2009 Beach ..... A63B 53/0466 473/345
7,591,738 B2 * 9/2009 Beach ..... A63B 60/00 473/345
7,621,823 B2 * 11/2009 Beach ..... A63B 53/0466 473/347
7,632,196 B2 * 12/2009 Reed ..... A63B 53/0466 473/324
7,651,412 B2 * 1/2010 Meyer ..... A63B 60/00 473/346

(56) References Cited

U.S. PATENT DOCUMENTS 7,674,189 B2 * 3/2010 Beach ..... A63B 60/00 473/345
7,704,163 B2 * 4/2010 Stites ..... A63B 53/047 473/334
7,731,603 B2 * 6/2010 Beach ..... A63B 60/02 473/335
7,749,096 B2 * 7/2010 Gibbs ..... A63B 53/02 473/335
7,753,809 B2 * 7/2010 Cackett ..... A63B 53/0466 473/345
7,758,454 B2 * 7/2010 Burnett ..... A63B 53/0466 473/345
7,771,291 B1 * 8/2010 Willett ..... A63B 60/00 473/345
7,775,905 B2 * 8/2010 Beach ..... A63B 60/00 473/256
7,806,782 B2 * 10/2010 Stites ..... A63B 53/06 473/409
7,931,546 B2 * 4/2011 Bennett ..... A63B 53/0466 473/345
7,934,999 B2 * 5/2011 Cackett ..... A63B 60/00 473/244
7,946,931 B2 * 5/2011 Oyama ..... A63B 53/0466 473/345
8,007,371 B2 * 8/2011 Breier ..... A63B 53/0466 473/345
8,012,038 B1 * 9/2011 Beach ..... A63B 53/06 473/345
8,016,694 B2 * 9/2011 Llewellyn ..... A63B 53/04 473/335
8,096,896 B2 * 1/2012 De Schiell ..... A63B 53/0466 473/347
8,133,128 B2 * 3/2012 Boyd ..... A63B 60/00 473/290
8,202,175 B2 * 6/2012 Ban ..... A63B 53/0466 473/345
8,206,243 B2 * 6/2012 Stites ..... A63B 60/02 473/345
8,226,501 B2 * 7/2012 Stites ..... A63B 53/0466 473/328
8,257,196 B1 * 9/2012 Abbott ..... A63B 60/02 473/335
8,262,495 B2 * 9/2012 Stites ..... A63B 53/04 473/226
8,262,507 B1 * 9/2012 Willett ..... A63B 53/06 473/335
8,337,319 B2 * 12/2012 Sargent ..... A63B 53/0466 473/307
8,360,900 B2 * 1/2013 Snyder ..... A63B 53/0466 473/345
8,419,569 B2 * 4/2013 Bennett ..... A63B 53/04 473/345
8,506,421 B2 * 8/2013 Stites ..... A63B 53/0466 473/335
8,517,851 B2 * 8/2013 Cackett ..... A63B 60/00 473/307
8,517,862 B2 * 8/2013 Stites ..... A63B 53/047 473/345
8,579,725 B1 * 11/2013 Willett ..... A63B 53/0466 473/335
8,608,591 B2 * 12/2013 Chao ..... A63B 60/00 473/345
8,684,862 B2 * 4/2014 Tavares ..... A63B 53/047 473/332
8,696,491 B1 * 4/2014 Myers ..... A63B 60/02 473/345
8,827,835 B1 * 9/2014 Griffin ..... A63B 60/54 473/332
8,834,294 B1 * 9/2014 Seluga ..... A63B 53/04 473/345
8,894,506 B1 * 11/2014 Myers ..... A63B 60/52 473/335
8,900,072 B1 * 12/2014 Willett ..... A63B 53/06 473/345
8,956,244 B1 * 2/2015 Westrum ..... A63B 53/06 473/345
9,033,821 B2 * 5/2015 Beach ..... A63B 53/0466 473/334
9,044,660 B2 * 6/2015 Selfridge ..... A63B 53/0466
9,162,115 B1 * 10/2015 Beach ..... A63B 60/00
9,452,327 B2 * 9/2016 Willett ..... A63B 60/00
9,623,295 B2 * 4/2017 Willett ..... F15D 1/10
9,776,059 B1 * 10/2017 Buday ..... A63B 53/0466
9,789,372 B2 * 10/2017 Beach ..... A63B 53/06
9,947,840 B2 4/2018 Yuasa et al.
10,035,054 B2 * 7/2018 Willett ..... A63B 60/00
10,441,859 B2 * 10/2019 Willett ..... A63B 60/00
10,835,790 B2 * 11/2020 Willett ..... A63B 53/0466
2003/0148818 A1 * 8/2003 Myrhum ..... A63B 69/3658 473/290
2003/0199336 A1 * 10/2003 Lovett ..... A63B 53/04 473/344
2005/0159245 A1 7/2005 Chen
2005/0215353 A1 * 9/2005 Schweigert ..... A63B 60/02 473/349
2006/0052185 A1 3/2006 Kawaguchi et al.
2006/0154747 A1 7/2006 Beach
2006/0223653 A1 10/2006 Iizuka
2007/0105655 A1 5/2007 Beach et al.
2010/0105499 A1 * 4/2010 Roach ..... A63B 60/00 473/335

FOREIGN PATENT DOCUMENTS

JP 03170175 A * 7/1991
JP 03170175 A 7/1991
JP 06071002 A * 3/1994
JP 06071002 A 3/1994
JP 07227443 A 8/1995
JP 07227443 A * 8/1995
JP 08112380 A 5/1996
JP 08112380 A * 5/1996
JP 08155063 A * 6/1996
JP 09-308717 12/1997
JP 09308717 A 12/1997
JP 09308717 A * 12/1997 ..... A63B 53/04
JP 10-277187 10/1998
JP 10277187 A * 10/1998
JP 11155985 A * 6/1999
JP 11155985 A 6/1999
JP 2001000595 A * 1/2001
JP 2002126137 A * 5/2002
JP 2003236025 A 8/2003
JP 2003236025 A * 8/2003
JP 2004159680 A * 6/2004
JP 2004222911 A * 8/2004
JP 2005287679 A * 10/2005
JP 2005305169 A * 11/2005 ..... A63B 53/0466
JP 2006000435 A * 1/2006
JP 2006095055 A * 4/2006
JP 2006122334 A * 5/2006
JP 2006187489 A * 7/2006
JP 2006204811 A * 8/2006
JP 2006212407 A * 8/2006
JP 2006223331 A * 8/2006
JP 2006288793 A * 10/2006
JP 2007229487 A * 9/2007 ..... A63B 53/04
JP 2007267777 A * 10/2007
JP 2008212623 A * 9/2008 ..... A63B 53/0466
WO WO-9319817 A1 * 10/1993 ..... A63B 53/04
WO WO 9319817 A1 10/1993

* cited by examiner

GOLF CLUB HEAD WITH VERTICAL CENTER OF GRAVITY ADJUSTMENT

CROSS REFERENCE TO RELATED APPLICATIONS

This application is a continuation of U.S. patent application Ser. No. 17/095,479, filed Nov. 11, 2020, which is a continuation of U.S. patent application Ser. No. 16/554,255, filed Aug. 28, 2019, which is a continuation of U.S. patent application Ser. No. 16/024,459, filed Jun. 29, 2018, which is a continuation of U.S. patent application Ser. No. 15/253,652, filed Aug. 31, 2016, which is a continuation of U.S. patent application Ser. No. 14/266,608, filed Apr. 30, 2014, which is a continuation of U.S. patent application Ser. No. 14/069,249, filed Oct. 31, 2013, which is a continuation of U.S. patent application Ser. No. 13/607,263, filed Sep. 7, 2012, which is a continuation of U.S. patent application Ser. No. 12/834,549, filed Jul. 12, 2010, which is a divisional of U.S. patent application Ser. No. 11/871,933, filed Oct. 12, 2007, all of which are incorporated herein by reference. Other applications and patents concerning golf club heads include U.S. patent application Ser. No. 11/669,891, now U.S. Pat. No. 7,771,291, U.S. patent application Ser. No. 11/669,894, U.S. patent application Ser. No. 11/669,900, U.S. patent application Ser. No. 11/669,907, U.S. patent application Ser. No. 11/669,910, U.S. patent application Ser. No. 11/669,916, U.S. patent application Ser. No. 11/669,920, U.S. patent application Ser. No. 11/669,925, and U.S. patent application Ser. No. 11/669,927 all filed on Jan. 31, 2007, which are continuations of U.S. patent application Ser. No. 11/067,475, filed Feb. 25, 2005, now U.S. Pat. No. 7,186,190, which is a continuation-in-part of U.S. patent application Ser. No. 10/785,692, filed Feb. 23, 2004, now U.S. Pat. No. 7,166,040, which is a continuation-in-part of U.S. patent application Ser. No. 10/290,817, now U.S. Pat. No. 6,773,360. These applications are incorporated herein by reference.

FIELD

The present application is directed to a golf club head, particularly a golf club head having movable weights.

BACKGROUND

The center of gravity (CG) of a golf club head is a critical parameter of the club's performance. Upon impact, the position of the CG greatly affects launch angle and flight trajectory of a struck golf ball. Thus, much effort has been made over positioning the center of gravity of golf club heads. To that end, current driver and fairway wood golf club heads are typically formed of lightweight, yet durable material, such as steel or titanium alloys. These materials are typically used to form thin club head walls. Thinner walls are lighter, and thus result in greater discretionary weight, i.e., weight available for redistribution around a golf club head. Greater discretionary weight allows golf club manufacturers more leeway in assigning club mass to achieve desired golf club head mass distributions.

Various approaches have been implemented for positioning discretionary mass about a golf club head. Many club heads have integral sole weight pads cast into the head at predetermined locations to lower the club head's center of gravity. Also, epoxy may be added to the interior of the club head through the club head's hosel opening to obtain a final desired weight of the club head. To achieve significant localized mass, weights formed of high-density materials have been attached to the sole, skirt, and other parts of a club head. With these weights, the method of installation is critical because the club head endures significant loads at impact with a golf ball, which can dislodge the weight. Thus, such weights are usually permanently attached to the club head and are limited in total mass. This, of course, permanently fixes the club head's center of gravity.

Golf swings vary among golfers, but the total weight and center of gravity location for a given club head is typically set for a standard, or ideal, swing type. Thus, even though the weight may be too light or too heavy, or the center of gravity too far forward or too far rearward, the golfer cannot adjust or customize the club weighting to his or her particular swing. Rather, golfers often must test a number of different types and/or brands of golf clubs to find one that is suited for them. This approach may not provide a golf club with an optimum weight and center of gravity and certainly would eliminate the possibility of altering the performance of a single golf club from one configuration to another and then back again.

It should, therefore, be appreciated that there is a need for a system for adjustably weighting a golf club head that allows a golfer to fine-tune the club head to accommodate his or her swing. The present application fulfills this need and others.

SUMMARY

Wood-type golf club heads include a body comprising a face plate positioned at a forward portion of the golf club head, a sole positioned at a bottom portion of the golf club head, a crown positioned at a top portion of the golf club head and a skirt positioned around a periphery of the golf club head between the sole and the crown. The body defines an interior cavity, and at least a first weight port is formed in the crown, and at least a first weight is configured to be retained at least partially within the first weight port. In a representative example, the wood type golf club head has a golf club head origin positioned on the face plate at an approximate geometric center of the face plate, the head origin including an x-axis tangential to the face plate and generally parallel to the ground when the head is ideally positioned, a y-axis generally perpendicular to the x-axis and generally parallel to the ground when the head is ideally positioned, and a z-axis generally perpendicular to the x-axis and to the y-axis and generally perpendicular to the ground when the head is ideally positioned, wherein a positive x-axis extends toward a club head heel, a positive y-axis extends toward the cavity, and a positive z-axis extends away from the ground with the head ideally positioned. In some examples, the first weight port has a longitudinal weight port radial axis and the first weight port is oriented such that the weight port radial axis and the positive z-axis form a weight port radial axis angle between about 10 degrees and about 80 degrees. In additional examples, the wood type golf club head has a weight port radial axis angle between about 25 degrees and about 65 degrees. In some examples, second and third weight ports are situated in the club head body, wherein the second weight port is situated at a toe portion of the club head and the third weight port is situated at a heel portion of the club head. In other examples, a mass of each of the first, second, and the third weights is between about 1 g and 18 g.

In further representative examples, wood-type golf club heads include a body that comprises a face plate positioned at a forward portion of the golf club head, a sole positioned at a bottom portion of the golf club head, a crown positioned at a top portion of the golf club head and a skirt positioned around a periphery of the golf club head between the sole and the crown, wherein the body defines an interior cavity. At least first, second, third and fourth weight ports can be formed in the body. At least a first weight is configured to be retained at least partially within the first weight port, at least a second weight is configured to be retained at least partially within the second weight port, at least a third weight is configured to be retained at least partially within the third weight port, and at least a fourth weight is configured to be retained at least partially within the fourth weight port. The club head has a golf club head origin positioned on the face plate at an approximate geometric center of the face plate, the head origin including an x-axis tangential to the face plate and generally parallel to the ground when the head is ideally positioned, a y-axis generally perpendicular to the x-axis and generally parallel to the ground when the head is ideally positioned, and a z-axis generally perpendicular to the x-axis and to the y-axis and generally perpendicular to the ground when the head is ideally positioned, wherein a positive x-axis extends toward a club head heel, a positive y-axis extends toward the cavity, and a positive z-axis extends away from the ground with the head ideally positioned. The first weight is positionable proximate a front toe portion of the golf club head, the second weight is positionable proximate a front heel portion of the golf club head, the third weight is positionable proximate a high rear portion of the golf club head, and the fourth weight is positionable proximate a low rear portion of the golf club head. In some examples, the third weight has a head origin z-axis coordinate between about −10 mm and about 20 mm, or a head origin z-axis coordinate between about 5 mm and 15 mm. In other examples, a golf club head center of gravity has a head origin z-axis coordinate between about −6 mm and about 1 mm.

In additional examples, the first weight has a head origin x-axis coordinate greater than about −40 mm and less than about −20 mm, the second weight has a head origin x-axis coordinate greater than about 20 mm and less than about 40 mm, the third weight has a head origin x-axis coordinate greater than about 0 mm and less than about 20 mm, and the fourth weight has a head origin x-axis coordinate greater than about 0 mm and less than about 20 mm. In still other examples, wherein the first weight has a head origin y-axis coordinate greater than about 5 mm and less than about 25 mm, the second weight has a head origin y-axis coordinate greater than about 5 mm and less than about 25 mm, the third weight has a head origin y-axis coordinate greater than about 80 mm and less than about 130 mm, and the fourth weight has a head origin y-axis coordinate greater than about 80 mm and less than about 130 mm. In another example, the first weight has a head origin z-axis coordinate greater than about −20 mm and less than about −10 mm, the second weight has a head origin z-axis coordinate greater than about −20 mm and less than about −10 mm, the third weight has a head origin z-axis coordinate greater than about 0 mm and less than about 20 mm, and the fourth weight has a head origin z-axis coordinate greater than about −30 mm and less than about −10 mm.

In some examples, the wood-type golf club head has a moment of inertia about a head center of gravity x-axis generally parallel to the origin x-axis of between about 140 $kg \cdot mm^2$ and about 500 $kg \cdot mm^2$. In additional examples, the wood-type golf club head has a moment of inertia about a head center of gravity z-axis generally parallel to the origin z-axis of between about 250 $kg \cdot mm^2$ and about 650 $kg \cdot mm^2$.

Wood-type golf club heads include a body comprising a face plate positioned at a forward portion of the golf club head, a sole positioned at a bottom portion of the golf club head, a crown positioned at a top portion of the golf club head and a skirt positioned around a periphery of the golf club head between the sole and the crown, wherein the body defines an interior cavity. At least first, second, and third weight ports are formed in the body, and at least one weight having a weight mass between about 5 grams and about 50 grams is configured to be retained at least partially within a weight port formed in the body. The head has a golf club head origin positioned on the face plate at an approximate geometric center of the face plate, the head origin including an x-axis tangential to the face plate and generally parallel to the ground when the head is ideally positioned, a y-axis generally perpendicular to the x-axis and generally parallel to the ground when the head is ideally positioned, and a z-axis generally perpendicular to the x-axis and to the y-axis, wherein a positive x-axis extends toward a club head heel, a positive y-axis extends toward the cavity, and a positive z-axis extends away from the ground with the head ideally positioned. When installed, at least one weight has a head origin z-axis coordinate greater than about 0 mm and a volume of the golf club head is between about 180 $cm^3$ and about 600 $cm^3$.

In additional examples, at least one weight, when installed, has a head origin z-axis coordinate between about 5 mm and 15 mm. In other examples, the installed at least one weight has a head origin y-axis coordinate between about 80 mm and 130 mm, and/or a head origin x-axis coordinate between about 0 mm and 20 mm. In other examples, the golf club head center of gravity has a head origin z-axis coordinate between about −6 mm and about 1 mm, or between about −5 mm and about 0 mm. In some examples, the golf club head center of gravity has a head origin y-axis coordinate greater than about 15 mm.

According to additional examples, wood-type golf club heads include a body comprising a face plate positioned at a forward portion of the golf club head, a sole positioned at a bottom portion of the golf club head, a crown positioned at a top portion of the golf club head and a skirt positioned around a periphery of the golf club head between the sole and the crown, wherein the body defines an interior cavity, wherein a volume of the golf club head is between about 180 $cm^3$ and about 600 $cm^3$. At least first, second, third, and fourth weight ports are formed in the body, and at least a first, second, third, and fourth weights having masses between about 1 g and about 100 g and are configured to be retained at least partially within the first, second, third, and fourth weight ports. A golf club head origin is positioned on the face plate at an approximate geometric center of the face plate, the head origin including an x-axis tangential to the face plate and generally parallel to the ground when the head is ideally positioned, a y-axis generally perpendicular to the x-axis and generally parallel to the ground when the head is ideally positioned, and a z-axis generally perpendicular to the x-axis and to the y-axis and generally perpendicular to the ground when the head is ideally positioned. As installed, the first weight has a head origin z-axis coordinate greater than about −20 mm and less than about −10 mm, the second weight has a head origin z-axis coordinate greater than about −20 mm and less than about −10 mm, the third weight has a head origin z-axis coordinate greater than about 5 mm and less than about 15 mm, and the fourth weight has a head origin z-axis coordinate greater than about −30 mm and less than about −10 mm.

In further examples, the first weight has a head origin x-axis coordinate greater than about −40 mm and less than about −20 mm, the second weight has a head origin x-axis coordinate greater than about 20 mm and less than about 40 mm, the third weight has a head origin x-axis coordinate greater than about 0 mm and less than about 20 mm, and the fourth weight has a head origin x-axis coordinate greater than about 0 mm and less than about 20 mm. In other examples, the first weight has a head origin y-axis coordinate greater than about 5 mm and less than about 25 mm, the second weight has a head origin y-axis coordinate greater than about 5 mm and less than about 25 mm, the third weight has a head origin y-axis coordinate greater than about 80 mm and less than about 130 mm, and the fourth weight has a head origin y-axis coordinate greater than about 80 mm and less than about 130 mm. In still further examples, a golf club head center of gravity has a head origin z-axis coordinate between about −6 mm and about 1 mm and/or the golf club head center of gravity has a head origin y-axis coordinate greater than about 15 mm.

In other examples, wood-type golf club heads include a body comprising a face plate positioned at a forward portion of the golf club head, a sole positioned at a bottom portion of the golf club head, a crown positioned at a top portion of the golf club head and a skirt positioned around a periphery of the golf club head between the sole and the crown, wherein the body defines an interior cavity, wherein the head has a golf club head origin positioned on the face plate at an approximate geometric center of the face plate, the head origin including an x-axis tangential to the face plate and generally parallel to the ground when the head is ideally positioned, a y-axis generally perpendicular to the x-axis and generally parallel to the ground when the head is ideally positioned, and a z-axis generally perpendicular to the x-axis and to the y-axis and generally perpendicular to the ground when the head is ideally positioned. At least a first weight port is configured to retain at least a first weight, wherein a center of gravity of the head is situated at a predetermined head origin y-coordinate that provides a dynamic loft and a head origin z-coordinate that at least partially compensates the dynamic loft. In some examples, the wood-type golf club heads include at least first, second, and third weight ports and first, second, and third weights configured to be retained within the first, second, and third weight ports, wherein the first weight port is situated so as to substantially establish the head origin z-coordinate of the head center of gravity. In other examples, wood-type golf club heads include at least first, second, and third weight ports and first, second, and third weights configured to be retained within the first, second, and third weight ports, wherein the first weight port is situated so as to have a head origin z-coordinate that is above the approximate geometric center of the face plate with the club ideally positioned.

In additional examples, at least first, second, third, and fourth weight ports and first, second, third, and fourth weights configured to be retained within the first, second, third, and fourth weight ports are provided. The first weight port and the second weight port are situated so as to substantially establish the head origin z-coordinate of the head center of gravity. In other examples, at least first, second, third, and fourth weight ports and first, second, third, and fourth weights configured to be retained within the first, second, third, and fourth weight ports are provided. The first weight port and the second weight port are situated so as to substantially establish the head origin z-coordinate of the head center of gravity. In additional examples, at least first, second, third, and fourth weight ports and first, second, third, and fourth weights configured to be retained within the first, second, third, and fourth weight ports are provided. The first weight port and the second weight port are situated so as to substantially establish the head origin z-coordinate of the head center of gravity above the approximate geometric center of the face plate with the club ideally positioned.

The foregoing and other objects, features, and advantages of the invention will become more apparent from the following detailed description, which proceeds with reference to the accompanying figures.

DETAILED DESCRIPTION

Disclosed below are representative embodiments that are not intended to be limiting in any way. Instead, the present disclosure is directed toward novel and nonobvious features, aspects and equivalents of the embodiments of the golf club information system described below. The disclosed features and aspects of the embodiments can be used alone or in various novel and nonobvious combinations and sub-combinations with one another.

Figure 1:
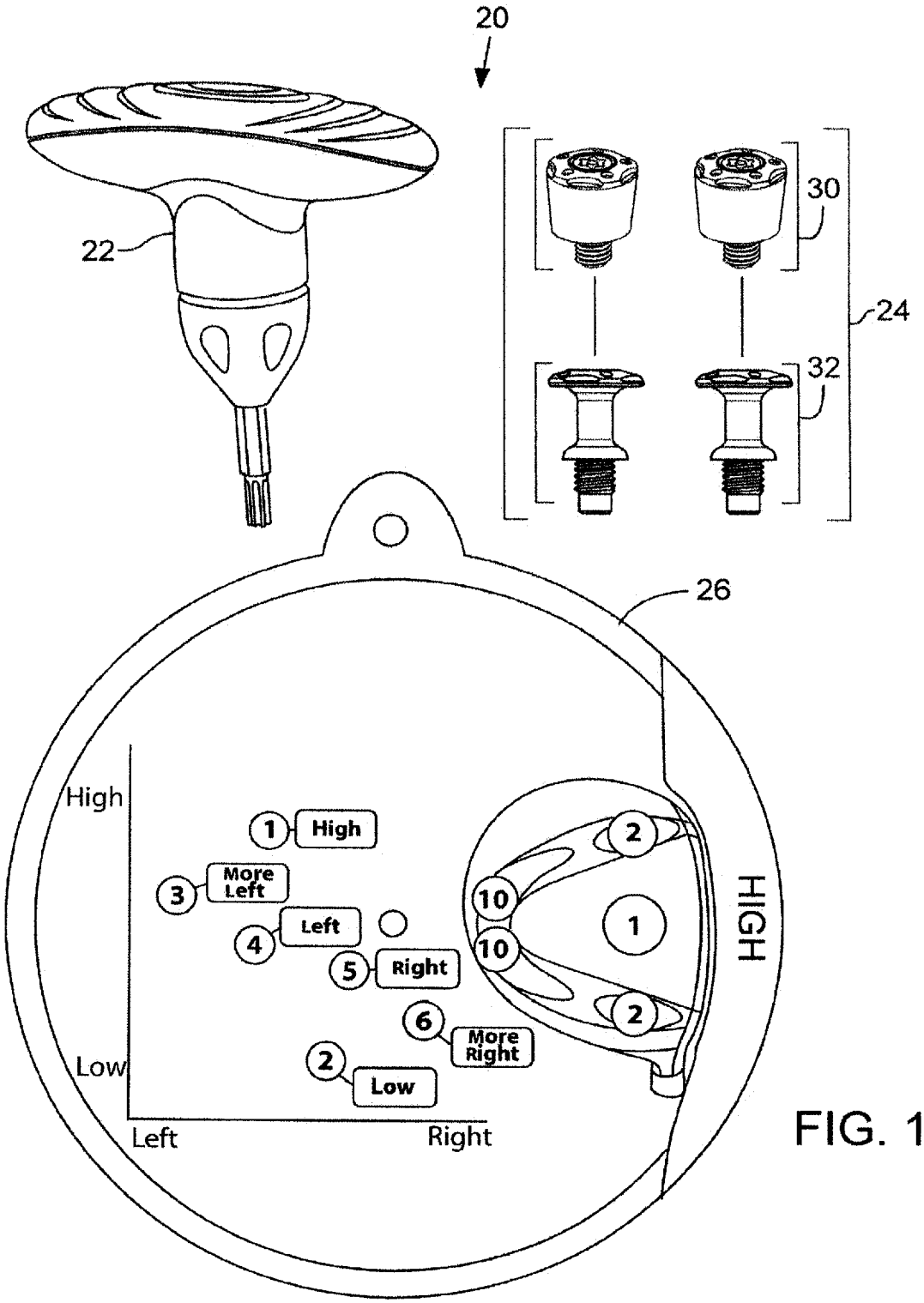
FIG. 1 is a perspective view of an embodiment of a kit for adjustably weighting a golf club head in accordance with the invention.

Now with reference to an illustrative drawing, and particularly FIG. 1, there is shown a kit 20 having a driving tool, i.e., torque wrench 22, and a set of weights 24 usable with a golf club head having conforming recesses, including, for example, weight assemblies 30 and weight screws 23, and an instruction wheel 26. In one particular embodiment, a golf club head 28 includes four recesses, e.g., weight ports 96, 98, 102, 104, disposed about the periphery of the club head (FIGS. 2-5). In the illustrated embodiment of FIGS. 2-5, four weights 24 are provided; two weight assemblies 30 of about ten grams (g) and two weight screws 32 of about two grams (g). Varying placement of the weights within ports 96, 98, 102, and 104 enables the golfer to vary launch conditions of a golf ball struck by the club head 28, for optimum distance and accuracy. More specifically, the golfer can adjust the position of the club head's center of gravity (CG), for greater control over the characteristics of launch conditions and, therefore, the trajectory and shot shape of the struck golf ball.

Figure 15:
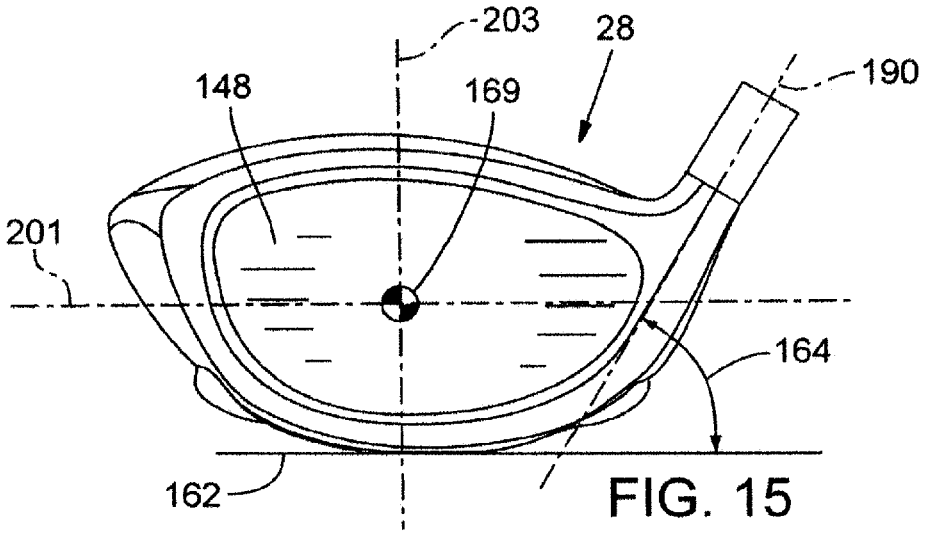
FIG. 15 is a front elevational view of the golf club head of FIG. 2 having four weight ports.

The instruction wheel 26 aids the golfer in selecting a proper weight configuration for achieving a desired effect to the trajectory and shape of the golf shot. In some embodiments, the kit 20 provides six different weight configurations for the club head 28, which provides substantial flexibility in positioning CG of the club head 28. Generally, the CG of a golf club head is the average location of the weight of the golf club head or the point at which the entire weight of the golf club head may be considered as concentrated so that if supported at this point the head would remain in equilibrium in any position. In the illustrated embodiment of FIGS. 15 and 16, the CG 169 of club head 28 can be adjustably located in an area adjacent to the sole having a length of about five millimeters measured from front-to-rear and width of about five millimeters measured from toe-to-heel.

Figure 20:
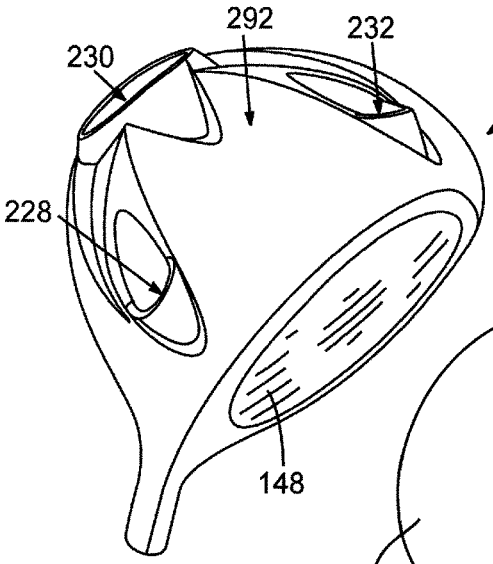
FIG. 20 is a bottom and front perspective view of a club head having four weight ports, wherein one weight port is in a club head crown.
Figure 21:
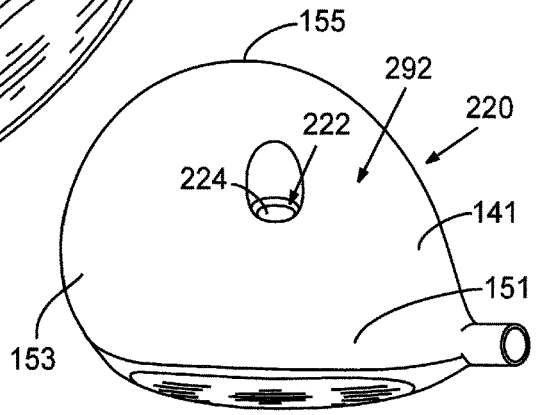
FIG. 21 is a top elevational view of the golf club head of FIG. 20.
Figure 22:
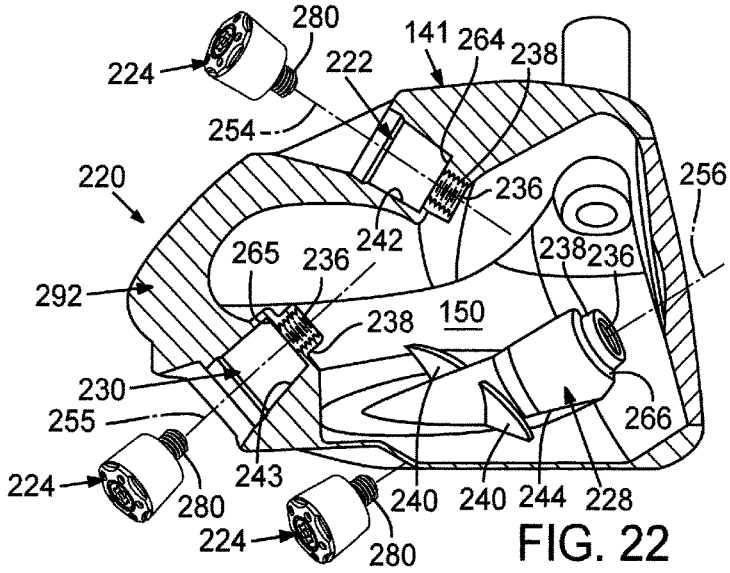
FIG. 22 is a cross-sectional view of the golf club head of FIG. 20.

In another embodiment illustrated in FIGS. 20-22, a golf club head 220 includes four recesses, e.g., weight ports 222, 228, 230, 232, disposed about the periphery of the club head 220. In another embodiment illustrated in FIGS. 23-25, a golf club head 320 includes four recesses, e.g., weight ports 322, 328, 330, 332, disposed about the periphery of the club head 320. In the illustrated embodiments of FIGS. 20-25, twelve weights, such as the weights 24 that include weight assemblies and weight screws may be provided; three weight assemblies of about one gram, four weight assemblies of about five and a quarter grams, one weight assembly of about six and a half grams, two weight assemblies of about nine and a half grams, one weight assembly of about twelve and a half grams, and one weight assembly of about eighteen grams. Varying placement of the weights within the ports 222, 228, 230, 232 enables the golfer to vary launch conditions of a golf ball struck by the club head 220, to provide a selected distance, spin rate, trajectory, or other shot characteristic or shot shape. Likewise, varying placement of the weights within ports 322, 328, 330, 332 enables the golfer to vary launch conditions of a golf ball struck by club head 320. More specifically, the golfer can adjust the position of club head center of gravity (CG) vertically and horizontally for greater control of launch conditions and, therefore, the trajectory, spin-rate, or shot shape of the struck golf ball. In some embodiments, the golfer may adjust the launch angle while maintaining a relatively constant spin-rate. In other embodiments, the golfer may adjust the spin-rate while maintaining a relatively constant launch angle.

In some embodiments, the kit 20 provides different weight configurations for the club head 320, which provide additional flexibility in positioning the CG of the club head 320. The CG of club head 320 can be adjustably located in a volume above the sole having a length of about seven millimeters measured from front-to-rear, a width of about five millimeters measured from toe-to-heel, and a height of about seven millimeters measured from crown-to-sole. The instruction wheel 26 shown in FIG. 1 can aid the golfer in selecting a proper weight configuration for the club head 320 for achieving a desired effect to the trajectory and shape of the golf shot. Each configuration can deliver different launch conditions, including ball launch angle, dynamic loft, spin-rate and the club head alignment at impact, as discussed in detail below.

As shown in FIGS. 2-5, the weights 24 can be sized to be securely received in any of the four ports 96, 98, 102, 104 of club head 28 and are secured in place using the torque wrench 22. The weights 24 can also be sized to be securely received in any of the four ports 222, 228, 230, 232 of club head 220 and secured in place using the torque wrench 22. In some embodiments, the weights 24 are sized to be securely received in any of the four ports 322, 328, 330, 332 of club head 320 and secured in place using the torque wrench 22.

Figure 9:
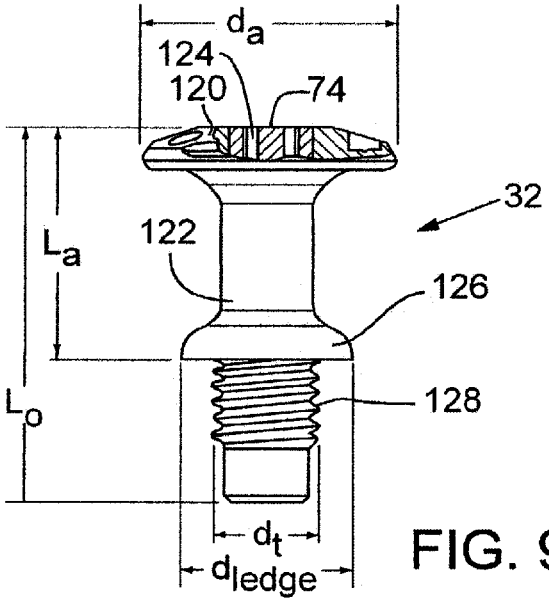
FIG. 9 is a side elevational view of a weight screw of the kit of FIG. 1.

Each of the weight assemblies 30 (FIGS. 10-12) includes a mass element 34, a fastener, e.g., screw 36, and a retaining element 38. In an exemplary embodiment, the weight assemblies 30 are preassembled; however, component parts can be provided for assembly by the user. For weights having a total mass between about one gram and about two grams, weight screws 32 without a mass element can be used (FIG. 9). The weight screws 32 can be formed of stainless steel, and the head 120 of each weight screw 32 preferably has a diameter sized to conform to the four ports 322, 328, 330, 332 of the club head 320, or alternatively to conform to the four ports 222, 228, 230, 232 of the club head 220.

The kit 20 can be provided with a golf club at purchase, or sold separately. For example, a golf club can be sold with the torque wrench 22, the instruction wheel 26, and the weights 24 (e.g., two 10-gram weights 30 and two 2-gram weights 32) preinstalled. Kits 20 having an even greater variety of weights can also be provided with the club, or sold separately. In another embodiment, a kit 20 having eight weight assemblies is contemplated, e.g., a 2-gram weight, four 6-gram weights, two 14-gram weights, and an 18-gram weight. Such a kit 20 may be particularly effective for golfers with a fairly consistent swing, by providing additional precision in weighting the club head 28. In another embodiment, the kit 20 may have twelve weight assemblies, e.g., three 1-gram weights, one 6.5-gram weight, four 5.25-gram weights, two 9.5-gram weights, one 12.5-gram weight, and one 18-gram weight. Such a kit may be preferred for golfers who prefer to adjust, in a relatively independent manner, the spin-rate and launch angle of a golf ball struck by a golf club head 320. Such a kit may also provide three-dimensional adjustment of the center of gravity of the golf club head 320.

In addition, weights in prescribed increments across a broad range can be available. For example, weights 24 in one gram increments ranging from one gram to twenty-five grams can provide very precise weighting, which would be particularly advantageous for advanced and professional golfers. In such embodiments, weight assemblies 30 ranging between five grams and ten grams preferably use a mass element 34 comprising primarily a titanium alloy. Weight assemblies 30, ranging between ten grams to over twenty-five grams, preferably use a mass element 34 comprising a tungsten-based alloy, or blended tungsten alloys. Other materials, or combinations thereof, can be used to achieve a desired weight mass. However, material selection should consider other requirements such as durability, size restraints, and removability.

Instruction Wheel

Figure 6:
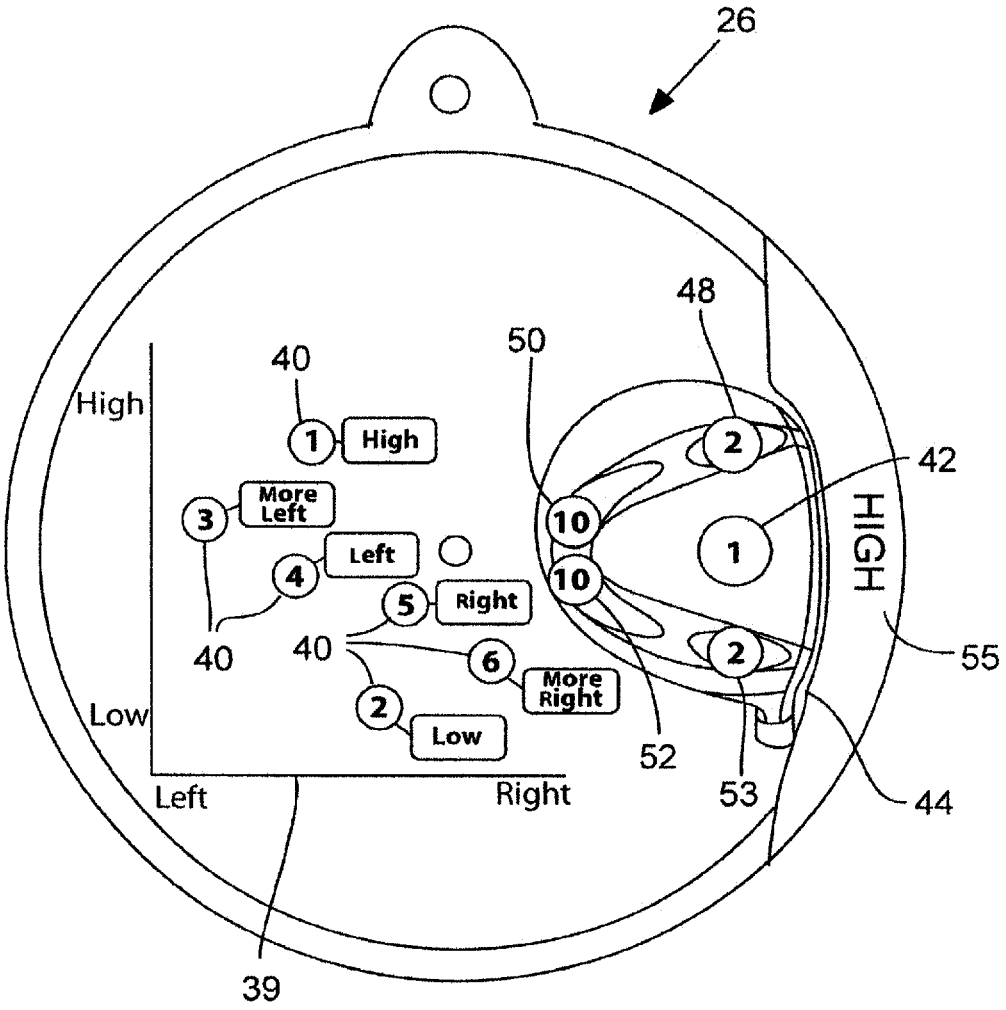
FIG. 6 is a plan view of the instruction wheel of the kit of FIG. 1.

With reference now to FIG. 6, the instruction wheel 26 aids the golfer in selecting a club head weight configuration to achieve a desired effect on the motion path of a golf ball struck by the golf club head 28. The instruction wheel 26 provides a graphic, in the form of a motion path chart 39 on the face of instruction wheel 26 to aid in this selection. The motion path chart's y-axis corresponds to the height control of the ball's trajectory, generally ranging from low to high. The x-axis of the motion path chart corresponds to the directional control of the ball's shot shape, ranging from left to right. In an exemplary embodiment, the motion path chart 39 identifies six different weight configurations 40. Each configuration is plotted as a point on the motion path chart 39. Of course, other embodiments can include a different number of configurations, such as, for kits having a different variety of weights. Also, other approaches for presenting instructions to the golfer can be used, for example, charts, tables, booklets, and so on. The six weight configurations of this exemplary embodiment are listed below in Table 1.

TABLE 1

| Config. | | Weight Distribution | | | |
|---|---|---|---|---|---|
| No. | Description | Fwd Toe | Rear Toe | Fwd Heel | Rear Heel |
| 1 | High | 2 g | 10 g | 2 g | 10 g |
| 2 | Low | 10 g | 2 g | 10 g | 2 g |
| 3 | More Left | 2 g | 2 g | 10 g | 10 g |
| 4 | Left | 2 g | 10 g | 10 g | 2 g |
| 5 | Right | 10 g | 2 g | 2 g | 10 g |
| 6 | More Right | 10 g | 10 g | 2 g | 2 g |

Each weight configuration (i.e., 1 through 6) corresponds to a particular effect on launch conditions and, therefore, a struck golf ball's motion path. In the first configuration, the club head CG is in a center-back location, resulting in a high launch angle and a relatively low spin-rate for optimal distance. In the second configuration, the club head CG is in a center-front location, resulting in a lower launch angle and lower spin-rate for optimal control. In the third configuration, the club head CG is positioned to induce a draw bias. The draw bias is even more pronounced with the fourth configuration. Whereas, in the fifth and sixth configurations, the club head CG is positioned to induce a fade bias, which is more pronounced in the sixth configuration.

Figure 2:
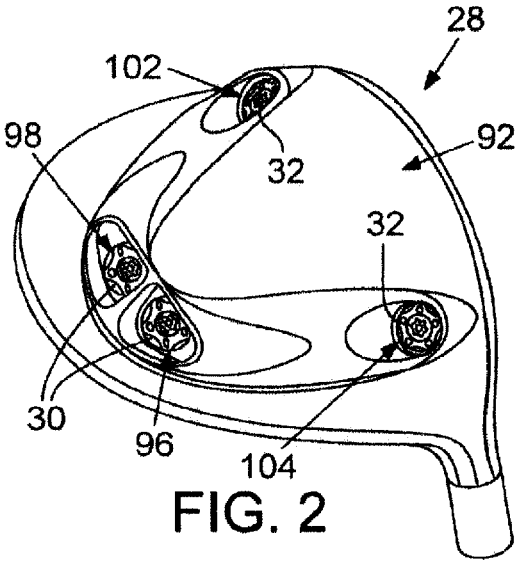
FIG. 2 is a bottom and rear side perspective view of a club head having four weight ports.
Figure 3:
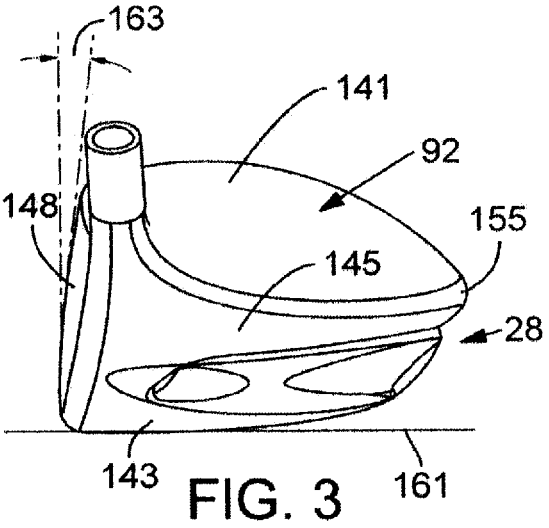
FIG. 3 is a side elevational view of the club head of FIG. 2, depicted from the heel side of the club head.
Figure 4:
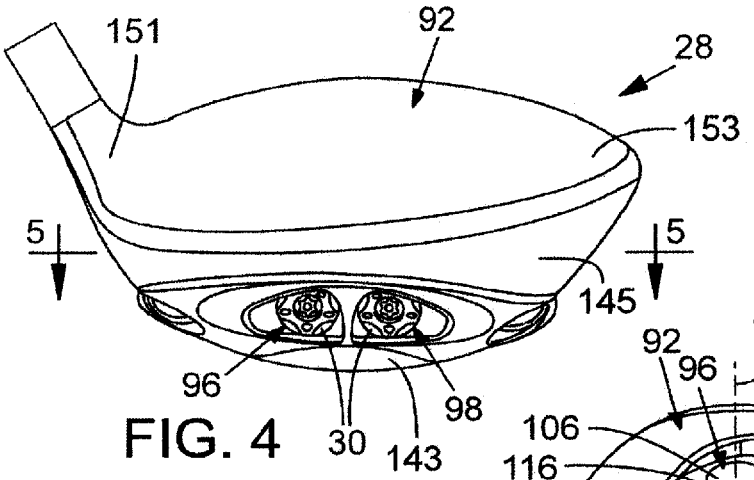
FIG. 4 is a rear elevational view of the club head of FIG. 2.

In use, the golfer selects, from the various motion path chart descriptions, the desired effect on the ball's motion path. For example, if hitting into high wind, the golfer may choose a golf ball motion path with a low trajectory, (e.g., the second configuration). Or, if the golfer has a tendency to hit the ball to the right of the intended target, the golfer may choose a weight configuration that encourages the ball's shot shape to the left (e.g., the third and fourth configurations). Once the configuration is selected, the golfer rotates the instruction wheel 26 until the desired configuration number is visible in the center window 42. The golfer then reads the weight placement for each of the four locations through windows 48, 50, 52, 53, as shown in the graphical representation 44 of the club head 28. The motion path description name is also conveniently shown along the outer edge 55 of the instruction wheel 26. For example, in FIG. 6, the instruction wheel 26 displays weight positioning for the "high" trajectory motion path configuration, i.e., the first configuration. In this configuration, two 10-gram weights are placed in the rear ports 96, 98 and two 2-gram weights are placed in the forward ports 102, 104 (FIG. 2). If another configuration is selected, the instruction wheel 26 depicts the corresponding weight distribution, as provided in Table 1, above.

In another embodiment, a kit similar to the kit 20 may provide an instruction wheel to aid the golfer in selecting a club head weight configuration to achieve a desired effect on the motion path of a golf ball struck by the golf club head 320. Such an instruction wheel may identify eleven different weight configurations. Of course, other embodiments can include a different number of configurations, such as, for kits having a different variety of weights. Also, other approaches for presenting instructions to the golfer can be used, for example, charts, tables, booklets, and so on. The eleven weight configurations of an exemplary embodiment are listed below in Table 2A and weight ranges for additional examples are listed in Tables 2B-2C.

TABLE 2A

| Config. No. | Description | Back Low (g) | Back High (g) | Front Heel (g) | Front Toe (g) |
|---|---|---|---|---|---|
| 1 | High, Neutral 1 | 18 | 1 | 1 | 1 |
| 2 | High, Neutral 2 | 9.5 | 9.5 | 1 | 1 |
| 3 | High Neutral 3 | 1 | 18 | 1 | 1 |
| 4 | High Draw | 12.5 | 1 | 6.5 | 1 |
| 5 | High Fade | 12.5 | 1 | 1 | 6.5 |
| 6 | Mid Neutral | 5.25 | 5.25 | 5.25 | 5.25 |
| 7 | Mid Draw | 1 | 9.5 | 9.5 | 1 |
| 8 | Mid Fade | 9.5 | 1 | 1 | 9.5 |
| 9 | Low Neutral | 1 | 1 | 9.5 | 9.5 |
| 10 | Low Draw | 1 | 1 | 18 | 1 |
| 11 | Low Fade | 1 | 1 | 1 | 18 |

TABLE 2B

| Config. No. | Description | Back Low (g) | Back High (g) | Front Heel (g) | Front Toe (g) |
|---|---|---|---|---|---|
| 1 | High Neutral 1 | 14.4 to 21.6 | 0.8 to 1.2 | 0.8 to 1.2 | 0.8 to 1.2 |
| 2 | High Neutral 2 | 7.6 to 11.4 | 7.6 to 11.4 | 0.8 to 1.2 | 0.8 to 1.2 |

TABLE 2B-continued

| Config. No. | Description | Back Low (g) | Back High (g) | Front Heel (g) | Front Toe (g) |
|---|---|---|---|---|---|
| 3 | High Neutral 3 | 0.8 to 1.2 | 14.4 to 21.6 | 0.8 to 1.2 | 0.8 to 1.2 |
| 4 | High Draw | 10 to 15 | 0.8 to 1.2 | 5.2 to 7.8 | 0.8 to 1.2 |
| 5 | High Fade | 10 to 15 | 0.8 to 1.2 | 0.8 to 1.2 | 5.2 to 7.8 |
| 6 | Mid Neutral | 4.2 to 6.3 | 4.2 to 6.3 | 4.2 to 6.3 | 4.2 to 6.3 |
| 7 | Mid Draw | 0.8 to 1.2 | 7.6 to 11.4 | 7.6 to 11.4 | 0.8 to 1.2 |
| 8 | Mid Fade | 7.6 to 11.4 | 0.8 to 1.2 | 0.8 to 1.2 | 7.6 to 11.4 |
| 9 | Low Neutral | 0.8 to 1.2 | 0.8 to 1.2 | 7.6 to 11.4 | 7.6 to 11.4 |
| 10 | Low Draw | 0.8 to 1.2 | 0.8 to 1.2 | 14.4 to 21.6 | 0.8 to 1.2 |
| 11 | Low Fade | 0.8 to 1.2 | 0.8 to 1.2 | 0.8 to 1.2 | 14.4 to 21.6 |

TABLE 2C

| Config. No. | Description | Back Low (g) | Back High (g) | Front Heel (g) | Front Toe (g) |
|---|---|---|---|---|---|
| 1 | High Neutral 1 | 16.2 to 19.8 | 0.9 to 1.1 | 0.9 to 1.1 | 0.9 to 1.1 |
| 2 | High Neutral 2 | 8.5 to 10.5 | 8.5 to 10.5 | 0.9 to 1.1 | 0.9 to 1.1 |
| 3 | High Neutral 3 | 0.9 to 1.1 | 16.2 to 19.8 | 0.9 to 1.1 | 0.9 to 1.1 |
| 4 | High Draw | 11.3 to 13.8 | 0.9 to 1.1 | 5.8 to 7.2 | 0.9 to 1.1 |
| 5 | High Fade | 11.3 to 13.8 | 0.9 to 1.1 | 0.9 to 1.1 | 5.8 to 7.2 |
| 6 | Mid Neutral | 4.7 to 5.8 | 4.7 to 5.8 | 4.7 to 5.8 | 4.7 to 5.8 |
| 7 | Mid Draw | 0.9 to 1.1 | 8.5 to 10.5 | 8.5 to 10.5 | 0.9 to 1.1 |
| 8 | Mid Fade | 8.5 to 10.5 | 0.9 to 1.1 | 0.9 to 1.1 | 8.5 to 10.5 |
| 9 | Low Neutral | 0.9 to 1.1 | 0.9 to 1.1 | 8.5 to 10.5 | 8.5 to 10.5 |
| 10 | Low Draw | 0.9 to 1.1 | 0.9 to 1.1 | 16.2 to 19.8 | 0.9 to 1.1 |
| 11 | Low Fade | 0.9 to 1.1 | 0.9 to 1.1 | 0.9 to 1.1 | 16.2 to 19.8 |

Each weight configuration (i.e., configurations 1 through 11) corresponds to a particular effect on launch conditions such as launch angle, spin-rate, and loft. Adjustments to these conditions tend to affect the shot-shape and the trajectory of the struck golf ball. In the first configuration, the club head CG is in a low-back location, resulting in a very high launch angle and low spin-rate. The launched ball tends to have a high trajectory when this configuration is chosen. In the second configuration, the club head CG is in a central-back location, resulting in a high launch angle, a moderate spin-rate, and high ball velocity. In the third configuration, the club head CG is in a high-back location, resulting in a low launch angle and a very high spin-rate. The launched ball tends to have a lower trajectory when this configuration is chosen. In the fourth configuration, the club head CG is in a low-back location and towards the heel to induce a strong draw bias with a very high launch angle and a low spin-rate. In the fifth configuration, the club head CG is in a low-back location and towards the toe to induce a strong fade bias with a very high launch angle and a low spin-rate. In the sixth configuration, the club head CG is positioned in a middle neutral position, resulting in a moderate to low launch angle, moderate spin, and high ball velocity. In the seventh configuration, the club head CG is positioned high-center and towards the heel. These launch conditions induce a moderate draw bias with high spin. In the eighth configuration, the club head CG is positioned low-center and towards the toe. These launch conditions induce a moderate fade bias with high launch angle. In the ninth configuration, the club head CG is positioned in a low-front location, resulting in a moderate launch angle and a moderate to low spin-rate. In the tenth configuration, the club head CG is in a low-front location to induce a draw bias, resulting in a moderate launch angle and a moderate spin-rate. In the eleventh configuration, the club head CG is in a low-front location to induce a fade bias, resulting in a moderate launch angle and moderate spin-rate.

In use, the golfer selects, from the various motion path descriptions, a desired effect on the ball's motion path. For example, if hitting into high wind, the golfer may choose a golf ball motion path with a lower trajectory and a lower spin-rate, (e.g., the ninth configuration). Or, if the golfer has a tendency to hit the ball to the right of the intended target, the golfer may choose a weight configuration that encourages the ball's shot shape to the left (e.g., the fourth, seventh, or tenth configurations). Once the configuration is selected, the golfer determines the weight configurations in a similar manner as with instruction wheel 26. If, for example, the fourth configuration of Table 2A is chosen for the exemplary golf club head 320 shown in FIGS. 23-25, a 12.5-gram weight is placed in the rear-low port 330, a 6.5-gram weight is placed in the front-heel port 328, a 1-gram weight is placed in the rear-high port 322, and a 1-gram weight is placed in the front-toe port 332. If another configuration is selected, the instruction wheel depicts the corresponding weight distribution as provided in Tables 2A-2C above.

The weight distributions described in Tables 2A-2C allow the golfer to adjust both launch angle and spin. Under some circumstances, the golfer may be able to adjust the launch angle and the spin relatively independently of each other to achieve optimal launch conditions. For example, a golfer may configure a golf club head 320 according to the sixth configuration in Table 2A. The golfer may then determine that the golf ball trajectory would improve if the spin-rate could be increased while the launch angle remained relatively constant. Such an outcome may result if the golfer then adjusted the weights in the golf club head 320 according to the third configuration.

Torque Wrench

Figure 7:
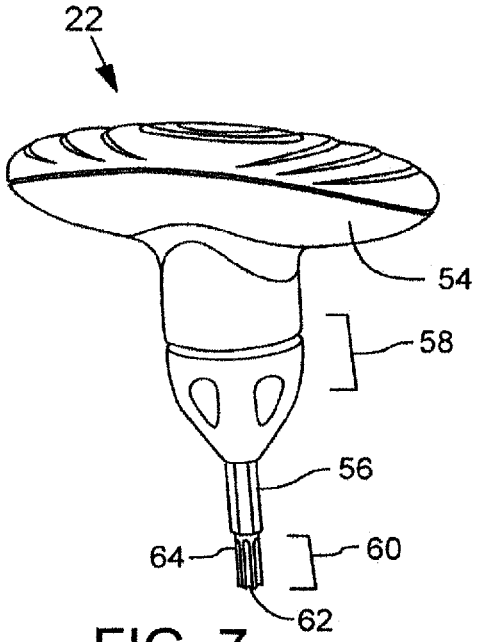
FIG. 7 is a perspective view of the tool of the kit of FIG. 1, depicting a grip and a tip.
Figure 8:
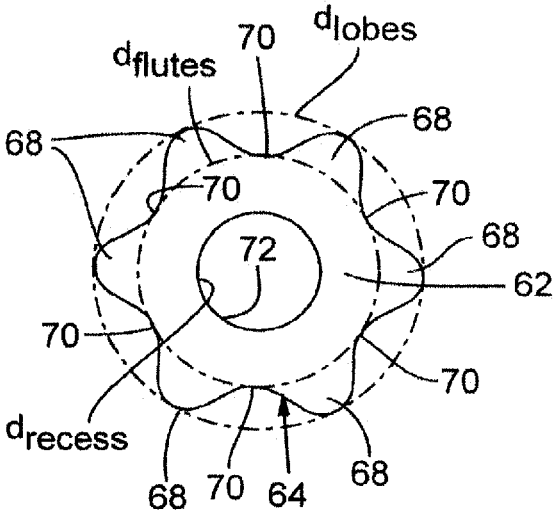
FIG. 8 is a close-up plan view of the tip of the tool of FIG. 7.

With reference now to FIGS. 7-8, the torque wrench 22 includes a grip 54, a shank 56, and a torque-limiting mechanism (not shown). The grip 54 and shank 56 generally form a T-shape; however, other configurations of wrenches can be used. The torque-limiting mechanism is disposed between the grip 54 and the shank 56, in an intermediate region 58, and is configured to prevent over-tightening of the weights 24 into weight ports such as ports 96, 98, 102, 104 or such as ports 222, 228, 230, 232. In use, once the torque limit is met, the torque-limiting mechanism of the exemplary embodiment will cause the grip 54 to rotationally disengage from the shank 56. In this manner, the torque wrench 22 inhibits excessive torque on the weight 24 being tightened. Preferably, the wrench 22 is limited to between about twenty inch-lbs and forty inch-lbs of torque. More preferably, the limit is between twenty-seven inch-lbs and thirty-three inch-lbs of torque. In an exemplary embodiment, the wrench 22 is limited to about thirty inch-lbs of torque. Of course, wrenches having various other types of torque-limiting mechanisms, or even without such mechanisms, can be used. However, if a torque-limiting mechanism is not used, care should be taken not to over-tighten the weights 24.

Figure 10:
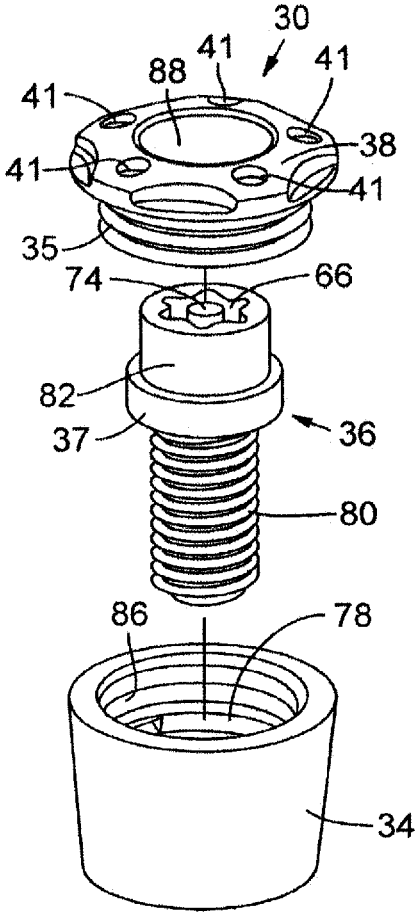
FIG. 10 is an exploded perspective view of a weight assembly of the kit of FIG. 1.
Figure 11:
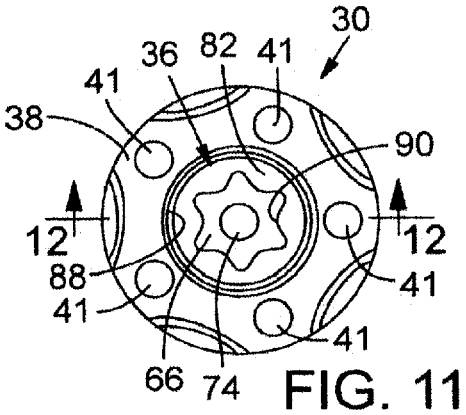
FIG. 11 is a top plan view of the weight assembly of FIG. 10.

The shank 56 terminates in an engagement end, i.e., tip 60, configured to operatively mate with the weight screws 32 and the weight assembly screws 36 (FIGS. 9-11). The tip 60 includes a bottom wall 62 and a circumferential side wall 64. As shown in FIGS. 10 and 11, the head of each of the weight screws 32 and weight assembly screws 36 define a socket 124 and 66, respectively, having a complementary shape to mate with the tip 60. The side wall 64 of the tip 60 defines a plurality of lobes 68 and flutes 70 spaced about the circumference of the tip. The multi-lobular mating of the wrench 22 and the sockets 66 and 124 ensures smooth application of torque and minimizes damage to either device (e.g., stripping of tip 60 or sockets 66, 124). The bottom wall 62 of the tip 66 defines an axial recess 72 configured to receive a post 74 disposed in sockets 66 and 124. The recess 72 is cylindrical and is centered about a longitudinal axis of the shank 56.

With reference now to FIG. 8, the lobes 68 and flutes 70 are spaced equidistant about the tip 60, in an alternating pattern of six lobes and six flutes. Thus, adjacent lobes 68 are spaced about 60 degrees from each other about the circumference of the tip 60. In the exemplary embodiment, the tip 60 has an outer diameter ($d_{lobes}$), defined by the crests of the lobes 68, of about 4.50 mm, and trough diameter ($d_{flutes}$) defined by the troughs of the flutes 70, of about 3.30 mm. The axial recess has a diameter ($d_{recess}$) of about 1.10 mm. Each socket 66, 124 is formed in an alternating pattern of six lobes 90 that complement the six flutes 70 of the wrench tip 60.

Weights

Generally, as shown in FIGS. 1 and 9-12, weights 24, including weight assemblies 30 and weight screws 32, are non-destructively movable about or within a golf club head. In specific embodiments, the weights 24 can be attached to the club head, removed, and reattached to the club head without degrading or destroying the weights or the golf club head. In other embodiments, the weights 24 are accessible from an exterior of the golf club head.

With reference now to FIG. 9, each weight screw 32 has a head 120 and a body 122 with a threaded portion 128. The weight screws 32 are preferably formed of titanium or stainless steel, providing a weight with a low mass that can withstand forces endured upon impacting a golf ball with the club head. In the exemplary embodiment, the weight screw 32 has an overall length ($L_o$) of about 18.3 mm and a mass of about two grams. In other embodiments, the length and composition of the weight screw 32 can be varied to satisfy particular durability and mass requirements. The weight screw head 120 is sized to enclose one of the corresponding weight ports 96, 98, 102, 104 (FIG. 2) of the club head 28, such that the periphery of the weight screw head 120 generally abuts the side wall of the port. This helps prevent debris from entering the corresponding port. Alternatively, the weight screw head 120 can be sized to enclose one of the corresponding weight ports 222, 228, 230, 232 of the club head 220. Preferably, the weight screw head 120 has a diameter ranging between about 11 mm and about 13 mm, corresponding to weight port diameters of various exemplary embodiments. In this embodiment, the weight screw head 120 has a diameter of about 12.3 mm. The weight screw head 120 defines a socket 124 having a multi-lobular configuration sized to operatively mate with the wrench tip 60.

The body 122 of the weight screw 32 includes an annular ledge 126 located in an intermediate region thereof. The ledge 126 has a diameter ($d_{ledge}$) greater than that of the threaded openings 110 defined in the ports 96, 98, 102, 104 of the club head 28 (FIG. 2), thereby serving as a stop when the weight screw 32 is tightened. In the embodiment, the annular ledge 126 is a distance ($L_a$) of about 11.5 mm from the weight screw head 120 and has a diameter ($d_a$) of about 6 mm. The weight screw body 122 further includes a threaded portion 128 located below the annular ledge 126. In this embodiment, M5×0.6 threads are used. The threaded portion 128 of the weight screw body 122 has a diameter ($d_t$) of about 5 mm and is configured to mate with the threaded openings 110 defined in the ports 96, 98, 102, 104 of the club head 28. Alternatively, the threaded portion 128 of the weight screw body 122 is configured to mate with the threaded openings 236 defined in the ports 222, 228, 230, 232 of the club head 220.

Figure 12:
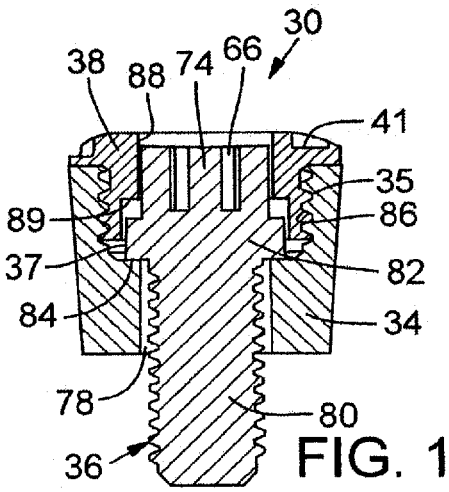
FIG. 12 is a cross-sectional view of the weight assembly of FIG. 10, taken along line 12-12 of FIG. 11.

With reference now to FIGS. 10-12, each mass element 34 of the weight assemblies 30 defines a bore 78 sized to freely receive the weight assembly screw 36. As shown in FIG. 12, the bore 78 includes a lower non-threaded portion and an upper threaded portion. The lower portion is sufficiently sized to freely receive a weight assembly screw body 80, while not allowing the weight assembly screw head 82 to pass. The upper portion of the bore 78 is sufficiently sized to allow the weight assembly screw head 82 to rest therein. More particularly, the weight assembly screw head 82 rests upon a shoulder 84 formed in the bore 78 of the mass element 34. Also, the upper portion of the bore 78 has internal threads 86 for securing the retaining element 38. In constructing the weight assembly 30, the weight assembly screw 36 is inserted into the bore 78 of the mass element 34 such that the lower end of the weight assembly screw body 80 extends out the lower portion of the bore 78 and the weight assembly screw head 82 rests within the upper portion of the bore 78. The retaining element 38 is then threaded into the upper portion of the bore 78, thereby capturing the weight assembly screw 36 in place. A thread locking compound can be used to secure the retaining element 38 to the mass element 34.

The retaining element 38 defines an axial opening 88, exposing the socket 66 of the weight assembly screw head 82 and facilitating engagement of the wrench tip 60 in the socket 66 of the weight assembly screw 36. As mentioned above, the side wall of the socket 66 defines six lobes 90 that conform to the flutes 70 (FIG. 8) of the wrench tip 60. The cylindrical post 74 of the socket 66 is centered about a longitudinal axis of the screw 36. The post 74 is received in the axial recess 72 (FIG. 8) of the wrench 22. The post 74 facilitates proper mating of the wrench 22 and the weight assembly screw 36, as well as inhibiting use of non-compliant tools, such as Phillips screwdrivers, Allen wrenches, and so on.

Club Head

As illustrated in FIGS. 2-5 and FIGS. 20-25, the golf club heads 28, 220, 320 include bodies 92, 292, 392, respectively. The body can include a crown 141, sole 143, skirt 145 and face plate 148 defining an interior cavity 150. The body further includes a heel portion 151, toe portion 153 and rear portion 155.

The crown 141 is defined as an upper portion of the golf club head above a peripheral outline of the head including the top of the face plate 148.

The sole 143 includes a lower portion of the golf club head extending upwards from a lowest point of the club head when the club head is ideally positioned, i.e., at a proper address position. For a typical driver, the sole 143 extends upwards approximately 15 mm above the lowest point when the club head is ideally positioned. For a typical fairway wood, the sole 143 extends upwards approximately 10 mm to about 12 mm above the lowest point when the club head is ideally positioned. A golf club head, such as the club head 28, can be ideally positioned when angle 163 measured between a plane tangent to an ideal impact location on the face plate and a perfectly vertical plane relative to the ground is approximately equal to the golf club head loft and when the golf club head lie angle is approximately equal to an angle between a longitudinal axis of the hosel or shaft and the ground 161. The ideal impact location is disposed at the geometric center of the face plate. The sole 143 can also include a localized zone 189 proximate the face plate 148 having a thickness between about 1 mm and about 3 mm, and extending rearwardly away from the face plate a distance greater than about 5 mm.

The skirt 145 is defined as a side portion of the golf club head between the crown and the sole that extends across a periphery of the golf club head, excluding the face plate, from the toe portion 153, around the rear portion 155, to the heel portion 151.

The crown 141, sole 143 and skirt 145 can be integrally formed using techniques such as molding, cold forming, casting, and/or forging and the face plate 148 can be attached to the crown, sole and skirt by means known in the art. Furthermore, the body 92 can be made from various metals (e.g., titanium alloys, aluminum alloys, steel alloys, magnesium alloys, or combinations thereof), composite material, ceramic material, or combinations thereof.

The face plate 148 is positioned generally at a front portion of the golf club head.

Figure 13:
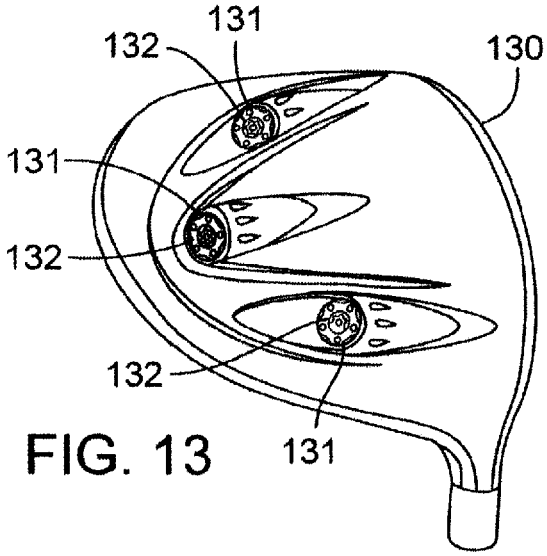
FIG. 13 is a bottom and rear perspective view of a golf club head of the present application having three weights and three weight ports.
Figure 14:
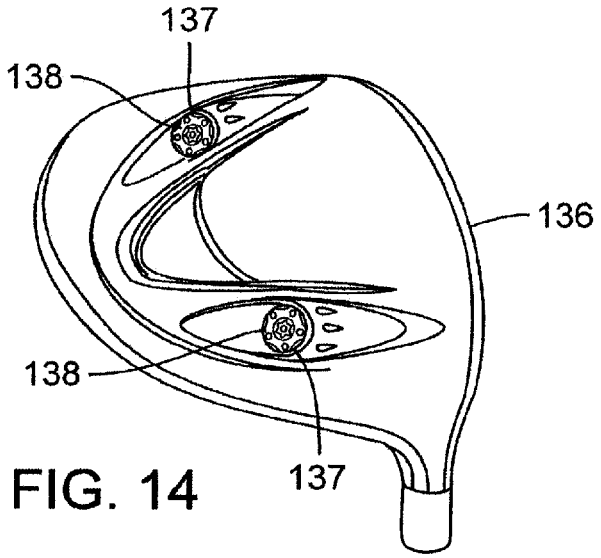
FIG. 14 is a bottom and rear perspective view of a golf club head of the present application having two weights and two weight ports.
Figure 23:
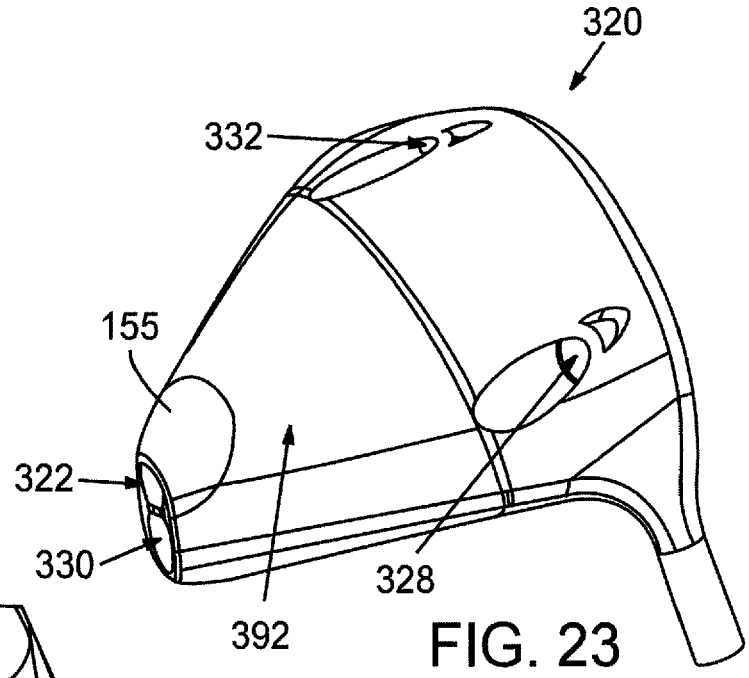
FIG. 23 is a bottom and rear perspective view of a golf club head having four weight ports.
Figure 24:
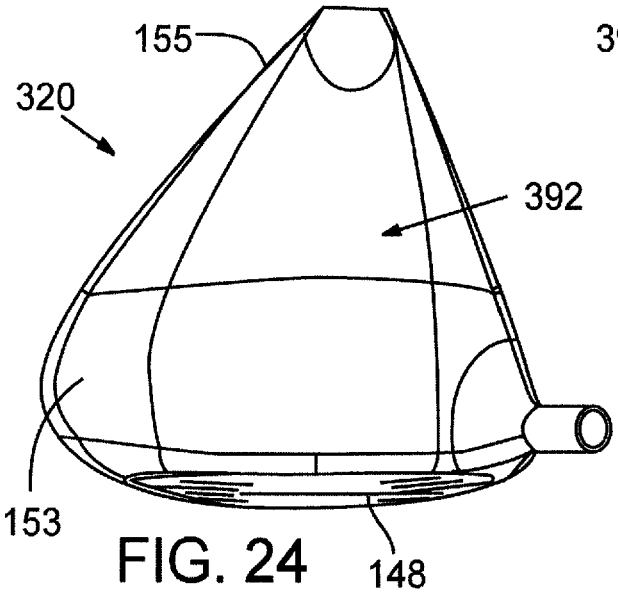
FIG. 24 is a top elevational view of the golf club head of FIG. 23.
Figure 25:
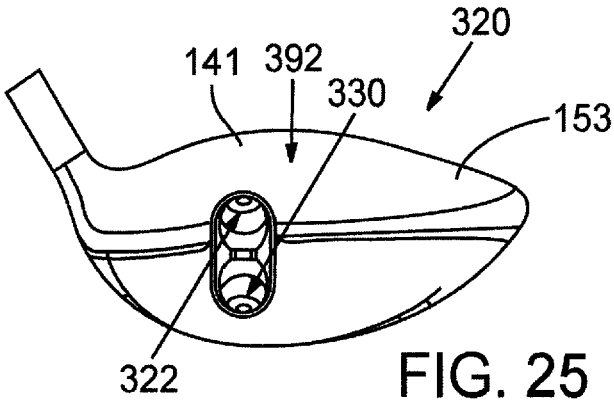
FIG. 25 is a rear elevational view of the golf club head of FIG. 23.

The golf club head of the present application can include one or more weight ports. For example, according to some embodiments, and as shown in FIGS. 2-5, the golf club head 28 can include the four weight ports 96, 98, 102 and 104 formed in the club head. In other embodiments, a golf club head can include less or more than four weight ports. For example, in some embodiments, as shown in FIG. 13, golf club head 130 can have three weight ports 131. In still other embodiments, as shown in FIG. 14, golf club head 136 can have two weight ports 137. In other embodiments, and as shown in FIGS. 20-22, the golf club head 220 can include the four weight ports 222, 228, 230, 232 formed in the club head. In still other embodiments, as shown in FIGS. 23-25, the golf club head 320 can include the four weight ports 322, 328, 330, 332 formed in the club head.

Figure 5:
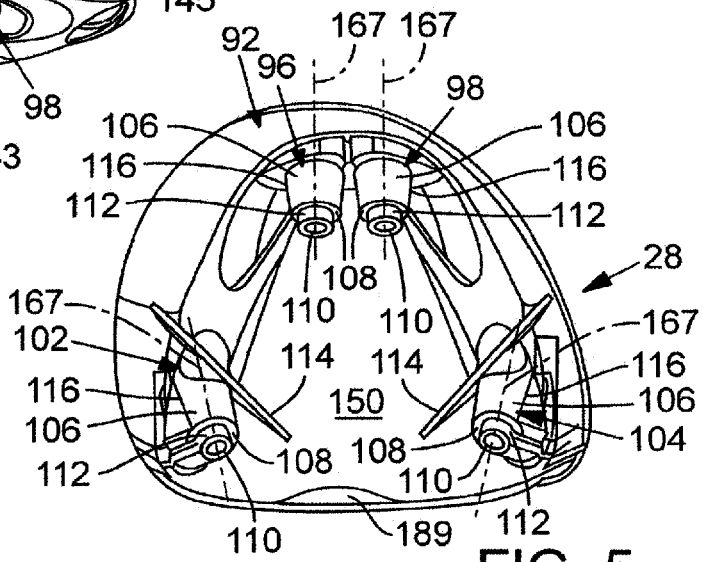
FIG. 5 is a cross sectional view of the club head of FIG. 2, taken along line 5-5 of FIG. 4.

Weight ports can be generally described as a structure coupled to the golf club head crown, golf club head skirt, golf club head sole or any combination thereof that defines a recess, cavity or hole on, about or within the golf club head. Exemplary of weight ports of the present application, weight ports 96, 98, 102, and 104 of FIGS. 2-5 include a weight cavity 116 and a port bottom 108. The ports have a weight port radial axis 167 defined as a longitudinal axis passing through a volumetric centroid, i.e., the center of mass or center of gravity, of the weight port. The port bottom 108 defines a threaded opening 110 for attachment of the weights 24. The threaded opening 110 is configured to receive and secure the threaded body 80 of the weight assembly 30 and threaded body 122 of the weight screw 32. In this embodiment, the threaded bodies 80 and 122 of the weight assembly 30 and weight screw 32, respectively, have M5×0.6 threads. The threaded opening 110 may be further defined by a boss 112 extending either inward or outward relative to the weight cavity 116. Preferably, the boss 112 has a length at least half the length of the body 80 of the screw 36 and, more preferably, the boss has a length 1.5 times a diameter of the body of the screw. As depicted in FIG. 5, the boss 112 extends outward, relative to the weight cavity 116 and includes internal threads (not shown). Alternatively, the threaded opening 110 may be formed without a boss.

As depicted in FIG. 5, the weight ports can include fins or ribs 114 having portions disposed about the ports 96, 98, 102 and 104, and portions formed in the body to provide support within the club head and reduce stresses on the golf club head walls during impact with a golf ball.

In the embodiment shown in FIGS. 2-5, the weights 24 are accessible from the exterior of the club head 28 and securely received into the ports 96, 98, 102, and 104. The weight assemblies 30 preferably stay in place via a press fit while the weights 32 are generally threadably secured. Weights 24 are configured to withstand forces at impact, while also being easy to remove.

In another embodiment, the weight ports 222, 230, 228 of FIGS. 20-22 include weight cavities 242, 243, 244 and port bottoms 264, 265, 266, respectively. (The weight port 232 is similarly configured.) The ports have weight port radial axes 254, 255, 256. The port bottoms 264, 265, 266 define respective threaded openings 236 for attachment of weight assemblies 224. The threaded openings 236 are configured to receive and secure assembly screw bodies 280 of the weight assemblies 224 or threaded bodies of weight screws, or other weights. In this embodiment, the threaded bodies 280 have M5×0.8 threads. The threaded openings 236 may be further defined by bosses 238 extending either inward or outward relative to the weight cavities 242, 243, 244. Preferably, the bosses 238 have a length at least half the length of the assembly screw body 280 and, more preferably, the bosses have a length 1.5 times a diameter of the body of the screw. As depicted in FIG. 22, the bosses 238 extend outward, relative to the weight cavities 242, 243, 244 and include internal threads. Alternatively, the threaded openings 236 may be formed without a boss.

As depicted in FIG. 22, the weight ports can include fins or ribs 240 having portions disposed about the ports 222, 228, 230, 232, and portions formed in the body to provide support within the club head and reduce stresses on the golf club head walls during impact with a golf ball.

In the embodiment shown in FIGS. 20-22, the weight assemblies 224 are accessible from the exterior of the club head 220 and securely received into the ports 222, 228, 230, 232. The weight assemblies 224 are generally threadably secured into the ports 222, 228, 230, 232. In other examples, the weight assemblies 224 may be retained via a press fit. Weight assemblies 224 are configured to withstand forces at impact, while also being easy to remove.

In some embodiments, four or more weights may be provided as desired. Yet in other embodiments, a golf club head can have fewer than four weights. For example, as shown in FIG. 13, golf club head 130 can have three weights 132 positioned around the golf club head 130 and, as shown in FIG. 14, golf club head 136 can have two weights 138 positioned around the golf club head 136. In some embodiments, each weight 132 and weight 138 can be a weight assembly or weight screw, such as the weight assembly 30 or weight screw 32.

To attach a weight assembly, such as weight assembly 30, in a port of a golf club head, such as the golf club head 28, the threaded body 30 of the screw 36 is positioned against the threaded opening 110 of the port. With the tip 60 of the wrench 22 inserted through the aperture 88 of the retaining element 38 and engaged in the socket 66 of the screw 36, the user rotates the wrench to screw the weight assembly in place. Pressure from the engagement of the screw 36 provides a press fit of the mass element 34 to the port, as sides of the mass element slide tightly against a wall of the weight cavity 116. The torque limiting mechanism of the wrench prevents over-tightening of the weight assembly 30.

Weight assemblies 30 are also configured for easy removal, if desired. To remove, the user mates the wrench 22 with the weight assembly 30 and unscrews it from a club head. As the user turns the wrench 22, the head 82 of the screw 36 applies an outward force on the retaining element 38 and thus helps pull out the mass element 34. Low-friction material can be provided on surfaces of the retaining element 38 and the mass element 34 to facilitate free rotation of the head 82 of the weight assembly screw 36 with respect to the retaining element 38 and the mass element 34.

Similarly, a weight screw, such as weight screws 32, can be attached to the body through a port by positioning the threaded portion of weight 32 against the threaded opening 110 of the port. The tip of the wrench can be used to engage the socket of the weight by rotating the wrench to screw the weight in place.

Attachment and removal of weights assemblies and weight screws is performed in a similar manner for other golf club head embodiments with one or more weight ports, such as the golf club head 220 and the golf club head 320.

A. MASS CHARACTERISTICS

A golf club head of the present application has a head mass defined as the combined masses of the body, weight ports and weights. The body mass typically includes the combined masses of the crown, sole, skirt and face plate, or equivalently, the head mass minus the total weight port mass and the total weight mass. The total weight mass is the combined masses of the weight or weights installed on a golf club head. The total weight port mass is the combined masses of the weight ports and any weight port supporting structures, such as fins 114 shown in FIG. 5.

In several embodiments, one weight port, including any weight port supporting structures, can have a mass between about 1 gram and about 12 grams. A golf club head having two weight ports may have a total weight port mass between about 2 grams and about 24 grams; a golf club head having three weight ports may have a total weight port mass between about 3 grams and about 36 grams; and a golf club head having four weight ports may have a total weight port mass between about 4 grams and about 48 grams.

In several embodiments of the golf club head, the sum of the body mass and the total weight port mass is between about 80 grams and about 222 grams. In more specific embodiments, the sum of the body mass and the total weight port mass is between about 80 grams and about 210 grams. In other embodiments, the sum of the body mass and the total weight port mass is less than about 205 grams or less than about 215 grams.

In some embodiments of the golf club head with two weight ports and two weights, the sum of the body mass and the total weight port mass can be between about 180 grams and about 222 grams. More specifically, in certain embodiments the sum of the body mass and the total weight port mass is between about 180 grams and about 215 grams or between about 198 grams and about 222 grams.

In specific embodiments of the golf club head 28, 130 with three weight ports 132 and three weights 131 or four weight ports 96, 98, 102, 104 and four weights 24, the sum of the body mass and the total weight port mass is between about 191 grams and about 211 grams. In the embodiments of FIGS. 20-25, the sum of the body mass and the total weight port mass is similar.

Each weight has a weight mass. In several embodiments, each weight mass can be between about 1 gram and about 100 grams. In specific embodiments, a weight mass can be between about 5 grams and about 100 grams or between about 5 grams and about 50 grams. In other specific embodiments, a weight mass can be between about 1 gram and about 3 grams, between about 1 gram and about 18 grams or between about 6 grams and about 18 grams.

In some embodiments, the total weight mass can be between about 5 grams and about 100 grams. In more specific embodiments, the total weight mass can be between about 5 grams and about 100 grams or between about 50 grams and about 100 grams.

B. VOLUME CHARACTERISTICS

The golf club head of the present application has a volume equal to the volumetric displacement of the club head body. In other words, for a golf club head with one or more weight ports within the head, it is assumed that the weight ports are either not present or are "covered" by regular, imaginary surfaces, such that the club head volume is not affected by the presence or absence of ports. In several embodiments, a golf club head of the present application can be configured to have a head volume between about 110 $cm^3$ and about 600 $cm^3$. In more particular embodiments, the head volume is between about 250 $cm^3$ and about 500 $cm^3$. In yet more specific embodiments, the head volume is between about 300 $cm^3$ and about 500 $cm^3$, between 300 $cm^3$ and about 360 $cm^3$, between about 360 $cm^3$ and about 420 $cm^3$ or between about 420 $cm^3$ and about 500 $cm^3$.

In embodiments having a specific golf club head weight and weight port configuration, or thin-walled construction as described in more detail below, the golf club can have approximate head volumes as shown in Table 3 below.

TABLE 3

| One Weight/Two Weight Ports ($cm^3$) | Two Weights/Two Weight Ports ($cm^3$) | Three Weights/Three Weight Ports ($cm^3$) | Four Weights/Four Weight Ports ($cm^3$) | Thin Sole Construction ($cm^3$) | Thin Skirt Construction ($cm^3$) |
|---|---|---|---|---|---|
| 180-600<br>385-600 | 110-210<br>180-600<br>250-600<br>400-500<br>440-460<br>385-600 | 360-460 | 360-460 | ≤500 | ≥205 |

The weight port volume is measured as the volume of the cavity formed by the port where the port is "covered" by a regular, imaginary surface as described above with respect to club head volume. According to several embodiments, a golf club head of the present invention has a weight port with a weight port volume between about 0.9 $cm^3$ and about 15 $cm^3$.

The total weight port volume is measured as the combined volumes of the weight ports formed in a golf club head. According to some embodiments of a golf club head of the present application, a ratio of the total weight port volume to the head volume is between about 0.001 and about 0.05, between about 0.001 and about 0.007, between about 0.007 and about 0.013, between about 0.013 and about 0.020 or between about 0.020 and about 0.05.

C. MOMENTS OF INERTIA

Golf club head moments of inertia are typically defined about axes extending through the golf club head CG. As used herein, the golf club head CG location can be provided with reference to its position on a golf club head origin coordinate system.

Figure 16:
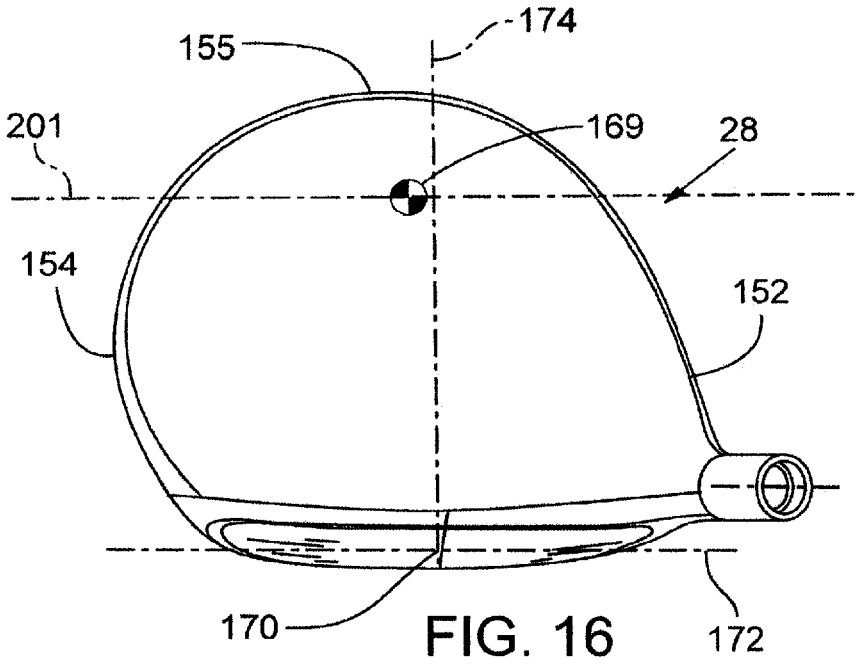
FIG. 16 is a top elevational view of the golf club head of FIG. 15.
Figure 17:
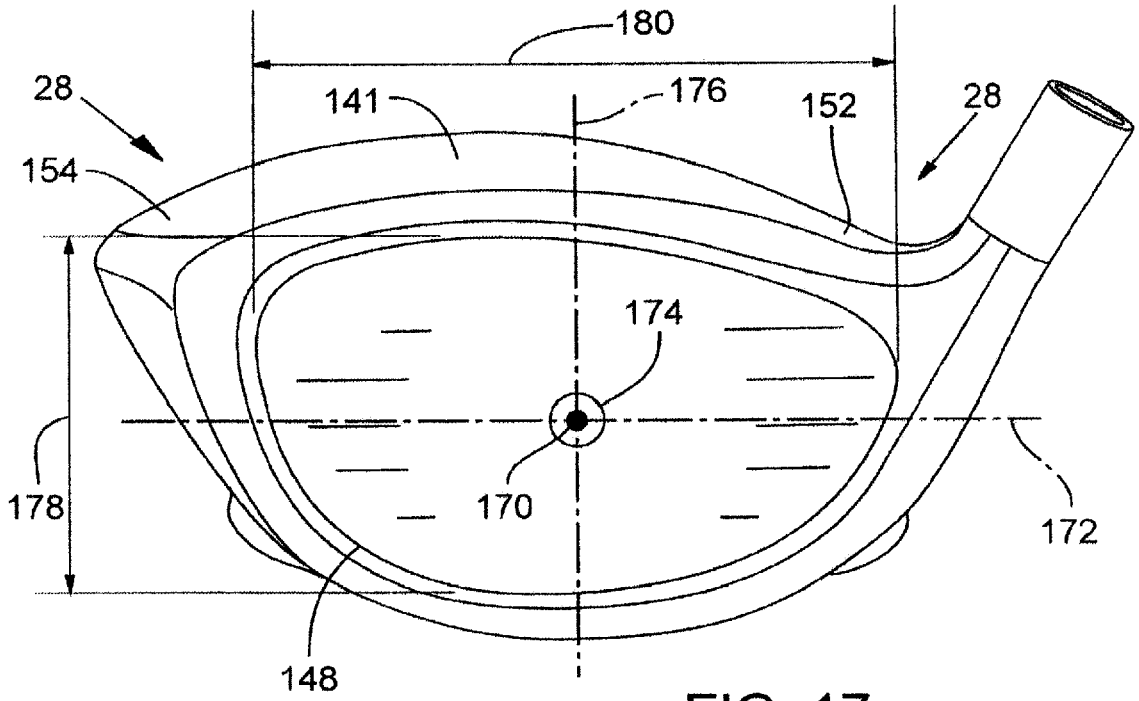
FIG. 17 is a front elevational view of the golf club head of FIG. 15 showing a golf club head origin coordinate system.

According to several embodiments, one of which is illustrated in FIGS. 16 and 17, a golf club head origin 170 is represented on golf club head 28. The golf club head origin 170 is positioned on the face plate 148 at approximately the geometric center, i.e., the intersection of the midpoints of a face plate's height and width. For example, as shown in FIG. 17, the head origin 170 is positioned at the intersection of the midpoints of the face plate height 178 and width 180.

As shown in FIGS. 16 and 17, the head origin coordinate system, with head origin 170, includes an x-axis 172 and a y-axis 174 (extending into the page in FIG. 17). The origin x-axis 172 extends tangential to the face plate and generally parallel to the ground when the head is ideally positioned with the positive x-axis extending from the origin 170 towards a heel 152 of the golf club head 28 and the negative x-axis extending from the origin to the toe of the golf club head. The origin y-axis 174 extends generally perpendicular to the origin x-axis and parallel to the ground when the head is ideally positioned with the positive y-axis extending from the origin 170 towards the rear portion 155 of the golf club. The head origin can also include an origin z-axis 176 extending perpendicular to the origin x-axis and the origin y-axis and having a positive z-axis that extends from the origin 170 towards the top portion of the golf club head 28 and a negative z-axis that extends from the origin towards the bottom portion of the golf club head.

A moment of inertia about a golf club head CG x-axis 201 (see FIGS. 15 and 16), i.e., an axis extending through the golf club head CG 169 and parallel to the head origin x-axis 172, is calculated by the following equation $$I_{CG_x}=\int(y^2+z^2)dm \quad (1)$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis 201 and a golf club head CG z-axis 203 (see FIG. 15), i.e., an axis extending through the golf club head CG 169 and parallel to the head origin z-axis 176 as shown in FIG. 17. The CG xy-plane is a plane defined by the CG x-axis 201 and a golf club head CG y-axis (not shown), i.e., an axis extending through the golf club head CG and parallel to the head origin y-axis.

Similarly, a moment of inertia about the golf club head CG z-axis 203 is calculated by the following equation $$I_{CG_z}=\int(x^2+y^2)dm \quad (2)$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis and the golf club head CG z-axis 203.

As used herein, the calculated values for the moments of inertia about the golf club head CG x-axis 201 and z-axis 203 are based on a golf club head with a body, at least one weight port coupled to the body and at least one installed weight.

1. Moments of Inertia about CG X-Axis

In several embodiments, the golf club head of the present invention can have a moment of inertia about the golf club head CG x-axis 201 between about 70 $kg{\cdot}mm^2$ and about 400 $kg{\cdot}mm^2$. More specifically, certain embodiments have a moment of inertia about the head CG x-axis 201 between about 140 $kg{\cdot}mm^2$ and about 225 $kg{\cdot}mm^2$, between about 225 $kg{\cdot}mm^2$ and about 310 $kg{\cdot}mm^2$ or between about 310 $kg{\cdot}mm^2$ and about 400 $kg{\cdot}mm^2$. In other examples, embodiments have a moment of inertia about a head CG x-axis of between about 400 $kg{\cdot}mm^2$ and about 430 $kg{\cdot}mm^2$.

In certain embodiments with two weight ports and two weights, the moment of inertia about the head CG x-axis 201 is between about 70 $kg{\cdot}mm^2$ and about 430 $kg{\cdot}mm^2$. In specific embodiments with two weight ports and one weight, the moment of inertia about the head CG x-axis 201 is between about 140 $kg{\cdot}mm^2$ and about 430 $kg{\cdot}mm^2$. Even more specifically, certain other embodiments have a moment of inertia about the head CG x-axis 201 between about 70 $kg{\cdot}mm^2$ and about 140 $kg{\cdot}mm^2$, between about 140 $kg{\cdot}mm^2$ and about 430 $kg{\cdot}mm^2$, between about 220 $kg{\cdot}mm^2$ and about 280 $kg{\cdot}mm^2$, or between about 220 $kg{\cdot}mm^2$ and about 360 $kg{\cdot}mm^2$.

In specific embodiments with three weight ports and three weights or four weight ports and four weights, the moment of inertia about the head CG x-axis 201 is between about 180 $kg{\cdot}mm^2$ and about 280 $kg{\cdot}mm^2$.

In some embodiments of a golf club head of the present application having a thin wall sole or skirt, as described below, a moment of inertia about the golf club head CG x-axis 201 can be greater than about 150 kg·mm$^2$. More specifically, the moment of inertia about the head CG x-axis 201 can be between about 150 kg·mm$^2$ and about 180 kg·mm$^2$, between about 180 kg·mm$^2$ and about 200 kg·mm$^2$ or greater than about 200 kg·mm$^2$.

A golf club head of the present invention can be configured to have a first constraint defined as the moment of inertia about the golf club head CG x-axis 201 divided by the sum of the body mass and the total weight port mass. According to some embodiments, the first constraint is between about 800 mm$^2$ and about 4,000 mm$^2$. In specific embodiments, the first constraint is between about 800 mm$^2$ and about 1,100 mm$^2$, between about 1,100 mm$^2$ and about 1,600 mm$^2$ or between about 1,600 mm$^2$ and about 4,000 mm$^2$.

A golf club head of the present application can be configured to have a second constraint defined as the moment of inertia about the golf club head CG x-axis 201 multiplied by the total weight mass. According to some embodiments, the second constraint is between about 1.4 g$^2$·mm$^2$ and about 40 g$^2$·mm$^2$. In certain embodiments, the second constraint is between about 1.4 g$^2$·mm$^2$ and about 2.0 g$^2$·mm$^2$, between about 2.0 g$^2$·mm$^2$ and about 10 g$^2$·mm$^2$ or between about 10 g$^2$·mm$^2$ and about 40 g$^2$·mm$^2$.

2. Moments of Inertia about CG Z-Axis

In several embodiments, the golf club head of the present invention can have a moment of inertia about the golf club head CG z-axis 203 between about 200 kg·mm$^2$ and about 600 kg·mm$^2$. More specifically, certain embodiments have a moment of inertia about the head CG z-axis 203 between about 250 kg·mm$^2$ and about 370 kg·mm$^2$, between about 370 kg·mm$^2$ and about 480 kg·mm$^2$ or between about 480 kg·mm$^2$ and about 600 kg·mm$^2$.

In specific embodiments with two weight ports and one weight, the moment of inertia about the head CG z-axis 203 is between about 250 kg·mm$^2$ and about 600 kg·mm$^2$.

In specific embodiments with two weight ports and two weights, the moment of inertia about the head CG z-axis 203 is between about 200 kg·mm$^2$ and about 600 kg·mm$^2$. Even more specifically, certain embodiments have a moment of inertia about the head CG z-axis 203 between about 200 kg·mm$^2$ and about 350 kg·mm$^2$, between about 250 kg·mm$^2$ and 600 kg·mm$^2$, between about 360 kg·mm$^2$ and about 450 kg·mm$^2$ or between about 360 kg·mm$^2$ and about 500 kg·mm$^2$.

In specific embodiments with three weight ports and three weights or four weight ports and four weights, the moment of inertia about the head CG z-axis 203 is between about 300 kg·mm$^2$ and about 450 kg·mm$^2$.

In some embodiments with a thin wall sole or skirt, a moment of inertia about a golf club head CG z-axis 203 can be greater than about 250 kg·mm$^2$. More specifically, the moment of inertia about head CG z-axis 203 can be between about 250 kg·mm$^2$ and about 300 kg·mm$^2$, between about 300 kg·mm$^2$ and about 350 kg·mm$^2$, between about 350 kg·mm$^2$ and about 400 kg·mm$^2$ or greater than about 400 kg·mm$^2$.

A golf club head can be configured to have a third constraint defined as the moment of inertia about the golf club head CG z-axis 203 divided by the sum of the body mass and the total weight port mass. According to some embodiments, the third constraint is between about 1,500 mm$^2$ and about 6,000 mm$^2$. In certain embodiments, the third constraint is between about 1,500 mm$^2$ and about 2,000 mm$^2$, between about 2,000 mm$^2$ and about 3,000 mm$^2$ or between about 3,000 mm$^2$ and about 6,000 mm$^2$.

A golf club head can be configured to have a fourth constraint defined as the moment of inertia about the golf club head CG z-axis 203 multiplied by the total weight mass. According to some embodiments, the fourth constraint is between about 2.5 g$^2$·mm$^2$ and about 72 g$^2$·mm$^2$. In certain embodiments, the fourth constraint is between about 2.5 g$^2$·mm$^2$ and about 3.6 g$^2$·mm$^2$, between about 3.6 g$^2$·mm$^2$ and about 18 g$^2$·mm$^2$ or between about 18 g$^2$·mm$^2$ and about 72 g$^2$·mm$^2$.

D. POSITIONING OF WEIGHT PORTS AND WEIGHTS

In some embodiments of the present application, the location, position or orientation of features of a golf club head, such as golf club head 28, can be referenced in relation to fixed reference points, e.g., a golf club head origin, other feature locations or feature angular orientations. The location or position of a weight, such as weight 24, is typically defined with respect to the location or position of the weight's center of gravity. Similarly, the location or position of a weight port is defined as the location or position of the weight port's volumetric centroid (i.e., the centroid of the cavity formed by a port where the port is "covered" by regular, imaginary surfaces as previously described with respect to club head volume and weight port volume). When a weight or weight port is used as a reference point from which a distance, i.e., a vectorial distance (defined as the length of a straight line extending from a reference or feature point to another reference or feature point) to another weight or weights port is determined, the reference point is typically the center of gravity of the weight or the volumetric centroid of the weight port.

1. Weight Coordinates

The location of a weight on a golf club head can be approximated by its coordinates on the head origin coordinate system as described above in connection with FIGS. 16 and 17. For example, in some embodiments, weights 24 can have origin x-axis 172 coordinates, origin y-axis 174 coordinates, and origin z-axis 176 coordinates on the coordinate system associated with golf club head origin 170.

In some embodiments of golf club head 28 having one weight 24, the weight can have an origin x-axis coordinate between about −60 mm and about 60 mm. In specific embodiments, the weight can have an origin x-axis coordinate between about −20 mm and about 20 mm, between about −40 mm and about 20 mm, between about 20 mm and about 40 mm, between about −60 and about −40 mm, or between about 40 mm and about 60 mm.

In some embodiments, a weight, such as weight 24, can have a y-axis coordinate greater than about 0 mm. More specifically, in certain embodiments, the weight 24 has a y-axis coordinate between about 0 mm and about 20 mm, between about 20 mm and about 50 mm or greater than about 50 mm.

In some embodiments, a weight, such as weight 24, can have a z-axis coordinate between about −30 mm and about 20 mm. In specific embodiments, the weight can have an origin z-axis coordinate between about −20 mm and about −10 mm, between about 0 mm and about 20 mm, between about 5 mm and about 15 mm, or between about −30 mm and about −10 mm.

In some embodiments including a first weight and a second weight, the first weight can have an origin x-axis coordinate between about −60 mm and about 0 mm and the second weight can have an origin x-axis coordinate between about 0 mm and about 60 mm. In certain embodiments, the first weight has an origin x-axis coordinate between about −52 mm and about −12 mm, between about −50 mm and about −10 mm, between about −42 mm and about −22 mm or between about −40 mm and about −20 mm. In certain embodiments, the second weight has an origin x-axis coordinate between about 10 mm and about 50 mm, between about 7 mm and about 42 mm, between about 12 mm and about 32 mm or between about 20 mm and about 40 mm. In some embodiments, the first and second weights can have respective y-axis coordinates between about 0 mm and about 130 mm. In certain embodiments, the first and second weights have respective y-axis coordinates between about 20 mm and about 40 mm, between about 20 mm and about 50 mm, between about 36 mm and about 76 mm or between about 46 mm and about 66 mm.

In certain embodiments of the golf club head 130 having first, second and third weights 131, the first weight can have an origin x-axis coordinate between about −47 mm and about −27 mm, the second weight can have an origin x-axis coordinate between about 22 mm and about 44 mm and the third weight can have an origin x-axis coordinate between about −30 mm and about 30 mm. In certain embodiments, the first and second weights can each have a y-axis coordinate between about 10 mm and about 30 mm, and the third weight can have a y-axis coordinate between about 63 mm and about 83 mm. In certain embodiments, the first weight and second weights can each have a z-axis coordinate between about −20 mm and about −10 mm, and the third weight can have a z-axis coordinate between about 0 mm and about 20 mm or between about −30 mm and about −10 mm.

In certain embodiments of the golf club head 28 having first, second, third and fourth weights 24, the first weight can have an origin x-axis coordinate between about −47 mm and about −27 mm, the second weight can have an origin x-axis coordinate between about 24 mm and about 44 mm, the third weight can have an origin x-axis coordinate between about −30 mm and about −10 mm and the fourth weight can have an origin x-axis coordinate between about 8 mm and about 28 mm. In certain embodiments, the first and second weights can each have a y-axis coordinate between about 10 mm and about 30 mm, and the third and fourth weights can each have a y-axis coordinate between about 63 mm and about 83 mm.

In certain embodiments of the golf club head 320 having first, second, third and fourth weights, the first weight can have an origin x-axis coordinate between about −33 mm and about −27 mm, the second weight can have an origin x-axis coordinate between about 28 mm and about 36 mm, the third and fourth weights can have an origin x-axis coordinate between about 9 mm and about 13 mm. In certain embodiments, the first and second weights can each have a y-axis coordinate between about 14 mm and about 18 mm, and the third and fourth weights can each have a y-axis coordinate between about 98 mm and about 120 mm. In certain embodiments, the first weight can have an origin z-axis coordinate between about −18 mm and about −14 mm, the second weight can have an origin z-axis coordinate between about −16 mm and about −12 mm, the third weight can have an origin z-axis coordinate between about 8 mm and about 10 mm, and the fourth weight can have an origin z-axis coordinate between about −21 mm and about −10 mm. Weight location ranges for two additional sets of examples (range 1 and range 2, respectively) of a four weight embodiment are listed in Table 4.

TABLE 4

| | Weight Locations (mm) | | | |
|---|---|---|---|---|
| Origin Axis | Weight 1 | Weight 2 | Weight 3 | Weight 4 |
| x, range 1 | 10.5 to 11.6 | 10.5 to 11.6 | 30.4 to 33.6 | −28.5 to −31.5 |
| y, range 1 | 104 to 115 | 104 to 115 | 15.9 to 17.5 | 15.2 to 16.8 |
| z, range 1 | −18.1 to −20 | 8.6 to 9.5 | −13.3 to −14.7 | −15.2 to −16.8 |
| x, range 2 | 10.8 to 11.2 | 10.8 to 11.2 | 31.4 to 32.6 | −29.4 to −30.6 |
| y, range 2 | 107 to 111 | 107 to 111 | 16.4 to 17.0 | 15.7 to 16.3 |
| z, range 2 | −18.6 to −19.4 | 8.8 to 9.2 | −13.7 to −14.3 | −15.7 to −16.3 |

2. Distance from Head Origin to Weights

The location of a weight on a golf club head of the present application can be approximated by its distance away from a fixed point on the golf club head. For example, the positions of the weights 24 about the golf club head 28 can be described according to their distances away from the golf club head origin 170.

In some embodiments of the golf club head 136 having a first weight 137 or a first weight and a second weight 137, distances from the head origin 170 to each weight can be between about 20 mm and 200 mm. In certain embodiments, the distances can be between about 20 mm and about 60 mm, between about 60 mm and about 100 mm, between about 100 mm and about 140 mm or between about 140 mm and about 200 mm.

In some embodiments of the golf club head 130 having three weights 131, including a first weight positioned proximate a toe portion of the golf club head, a second weight positioned proximate a heel portion of the golf club head and a third weight positioned proximate a rear portion of the golf club head, the distances between the head origin and the first and second weights, respectively, can be between about 20 mm and about 60 mm and the distance between the head origin and the third weight can be between about 40 mm and about 100 mm. More specifically, in certain embodiments, the distances between the head origin and the first and second weights, respectively, can be between about 30 mm and about 50 mm and the distance between the head origin and the third weight can be between about 60 mm and about 80 mm.

In some embodiments of the golf club head 28 having four weights 24, including a first weight positioned proximate a front toe portion of the golf club head, a second weight positioned proximate a front heel portion of the golf club head, a third weight positioned proximate a rear toe portion of the golf club head and a fourth weight positioned proximate a rear heel portion of the golf club head, the distances between the head origin and the first and second weights can be between about 20 mm and about 60 mm and the distances between the head origin and the third and fourth weights can be between about 40 mm and about 100 mm. More specifically, in certain embodiments, the distances between the head origin and the first and second weights can be between about 30 mm and about 50 mm and the distances between the head origin and the third and fourth weights can be between about 60 mm and about 80 mm.

3. Distance from Head Origin to Weight Ports

The location of a weight port on a golf club head can be approximated by its distance away from a fixed point on the golf club head. For example, the positions of one or more weight ports about the golf club head 28 can be described according to their distances away from the golf club head origin 170.

In some embodiments of the golf club head 136 having first and second weight ports 138, distances from the head origin 170 to each weight port can be between about 20 mm and 200 mm. In certain embodiments, the distances can be between about 20 mm and about 60 mm, between about 60 mm and about 100 mm, between about 100 mm and about 140 mm or between about 140 mm and about 200 mm.

4. Distance Between Weights and/or Weight Ports

The location of a weight and/or a weight port about a golf club head of the present application can also be defined relative to its approximate distance away from other weights and/or weight ports.

In some embodiments, a golf club head of the present application has only one weight and a first weight port and a second weight port. In such an embodiment, a distance between a first weight position, defined for a weight when installed in a first weight port, and a second weight position, defined for the weight when installed in a second weight port, is called a "separation distance." In some embodiments, the separation distance is between about 5 mm and about 200 mm. In certain embodiments, the separation distance is between about 50 mm and about 100 mm, between about 100 mm and about 150 mm or between about 150 mm and about 200 mm. In some specific embodiments, the first weight port is positioned proximate a toe portion of the golf club head and the second weight port is positioned proximate a heel portion of the golf club head.

In some embodiments of the golf club head 136 with two weights 137 and first and second weight ports 138, the two weights include a first weight and a second weight. In some embodiments, the distance between the first and second weights 137 is between about 5 mm and about 200 mm. In certain embodiments, the distance between the first and second weights 137 is between about 5 mm and about 50 mm, between about 50 mm and about 100 mm, between about 100 mm and about 150 mm or between about 150 mm and about 200 mm. In some specific embodiments, the first weight is positioned proximate a toe portion of the golf club head and the second weight is positioned proximate a heel portion of the golf club head.

In some embodiments of a golf club head having at least two weight ports, a distance between the first and second weight ports is between about 5 mm and about 200 mm. In more specific embodiments, the distance between the first and second weight ports is between about 5 mm and about 50 mm, between about 50 mm and about 100 mm, between about 100 mm and about 150 mm or between about 150 mm and about 200 mm. In some specific embodiments, the first weight port is positioned proximate a toe portion of the golf club head and the second weight port is positioned proximate a heel portion of the golf club head.

In some embodiments of the golf club head 130 having first, second and third weights 131, a distance between the first and second weights is between about 40 mm and about 100 mm, and a distance between the first and third weights, and the second and third weights, is between about 30 mm and about 90 mm. In certain embodiments, the distance between the first and second weights is between about 60 mm and about 80 mm, and the distance between the first and third weights, and the second and third weights, is between about 50 mm and about 70 mm. In some embodiments, the first weight is positioned proximate a toe portion of the golf club head, the second weight is positioned proximate a heel portion of the golf club head and the third weight is positioned proximate a rear portion of the golf club head.

In some embodiments of the golf club head 28 having first, second, third and fourth weights 24, a distance between the first and second weights, the first and fourth weights, and the second and third weights is between about 40 mm and about 100 mm; a distance between the third and fourth weights is between about 5 mm and about 80 mm; and a distance between the first and third weights and the second and fourth weights is about 30 mm to about 90 mm. In more specific embodiments, a distance between the first and second weights, the first and fourth weights, and the second and third weights is between about 60 mm and about 80 mm; a distance between the first and third weights and the second and fourth weights is between about 50 mm and about 70 mm; and a distance between the third and fourth weights is between about 5 mm and about 50 mm. In some specific embodiments, the first weight is positioned proximate a front toe portion of the golf club head, the second weight is positioned proximate a front heel portion of the golf club head, the third weight is positioned proximate a rear toe portion of the golf club head and the fourth weight is positioned proximate a rear heel portion of the golf club head. In other specific embodiments, the first weight is positioned proximate a front toe portion of the golf club head, the second weight is positioned proximate a front heel portion of the golf club head, the third weight is positioned proximate a high rear portion of the golf club head and the fourth weight is positioned proximate a low rear portion of the golf club head.

5. Weight Port Axis Angular Orientations

The weight port radial axis can be defined as having a positive weight port radial axis portion extending from the exterior of the club head into the cavity. In some embodiments of a golf club head of the present application, an angle formed between the weight port radial axis and a golf club head impact axis is between about 10 degrees and about 80 degrees. The golf club head impact axis can be defined as the origin y-axis 174 in the negative direction. In some specific embodiments, the angle is between about 25 degrees and about 65 degrees. The angled orientation of the weight port radial axis with respect to the golf club head impact axis is desirable to reduce the axial load on the weights and their associated retaining mechanism when the club head impacts a ball.

In some embodiments of a golf club head, an angle formed between the weight port radial axis and the origin z-axis in the positive direction is between about 10 degrees and about 80 degrees (i.e. generally downwards) or between about 100 degrees and about 170 degrees (i.e. generally upwards). For example, for weight ports formed in a high or upper portion of the club head body such as in the crown, an angle formed between the weight port radial axis and the origin z-axis in the positive direction is typically between about 10 degrees and about 80 degrees, while for weight ports formed in a lower portion of the club head body, an angle formed between the weight port radial axis and the origin z-axis in the positive direction is typically between about 100 degrees and about 170 degrees.

A relative weight port radial axis angle can be formed between a first weight port radial axis of a first port and a second weight port radial axis of a second port. In some embodiments of a golf club head of the present application, the relative weight port radial axis angle can be between about 0 degrees and about 170 degrees. In some embodiments, the relative weight port radial axis angle is between about 0 degrees and about 135 degrees. In some embodiments, the first and second ports can have essentially the same weight port radial axis angles and a relative weight port radial axis angle can be approximately 0 degrees. In some of the embodiments, the first and second ports can be both located in a front portion of a golf club head or both located in a low rear portion of the golf club head. In some embodiments, the relative weight port radial axis angle is nonzero. In some of these embodiments, the first port can be located in a front portion of a golf club head and the second port can be located in a rear portion of a golf club head, or the first port can be located in a high rear portion of a golf club head and the second port can be located in a low rear portion of a golf club head.

E. DISTANCE FROM HEAD ORIGIN TO HEAD CENTER OF GRAVITY

The location of the CG of a club head can be defined by its spatial relationship to a fixed point on the golf club head. For example, as discussed above, the location of the golf club head CG can be described according to the spatial relationship between the CG and the golf club head origin.

In some embodiments of a golf club head having one weight, the golf club head has a CG with a head origin x-axis coordinate between about −10 mm and about 10 mm and a head origin y-axis coordinate greater than about 15 mm or less than about 50 mm. In some embodiments, the CG has a head origin z-axis coordinate between about −6 mm and about 1 mm. In some embodiments of a golf club head having two weights, the golf club head has a CG with an origin x-axis coordinate between about −10 mm and about 10 mm or between about −4 mm and about 8 mm, and an origin y-axis coordinate greater than about 15 mm or between about 15 mm and about 50 mm. In some embodiments of a golf club head having three or four weights, the golf club head has a CG with an origin x-axis coordinate between about −3 mm and about 6 mm and an origin y-axis coordinate between about 20 mm and about 40 mm. In some embodiments of a golf club head having three or four weights, the CG has a head origin z-axis coordinate between about −6 mm and about 1 mm. In some embodiments of a golf club head having a thin sole or thin skirt construction, the golf club head has a CG with an origin x-axis coordinate between about −5 mm and about 5 mm, an origin y-axis coordinate greater than about 0 mm and an origin z-axis coordinate less than about 0 mm. In some embodiments of a golf club head having a weight in the crown or in a high rear portion of the golf club head body, the golf club head has a CG with an origin z-axis coordinate between about −6 mm and about 1 mm. In other embodiments of a golf club head having a weight in a high rear portion of the golf club head body, the golf club head has a CG with an origin z-axis coordinate between about −5 mm and about 0 mm. In other embodiments of a golf club head having three or four weights, the golf club head has a CG with an origin x-axis coordinate between about −3 mm and about 6 mm, an origin y-axis coordinate between about 20 mm and about 40 mm, and an origin z-axis coordinate between about −5 mm and about 0 mm.

More particularly, in specific embodiments of a golf club head having specific configurations, the golf club head has a CG with coordinates approximated in Table 5.

TABLE 5

| CG Coordinates | Two Weights | Three Weights | Four Weights | Thin Sole/Skirt Construction |
|---|---|---|---|---|
| origin x-axis coordinate (mm) | −3 to 8<br>−3 to 2<br>2 to 6<br>−2 to 1<br>2 to 5<br>−4 to 6<br>−4 to 4<br>−2 to 6 | −3 to 6<br>−1 to 4<br>−3 to 3<br>0 to 6 | −3 to 6<br>−1 to 4<br>−3 to 3 | −2 to 2<br>−1 to 1 |
| origin y-axis coordinate (mm) | 15 to 25<br>25 to 35<br>35 to 50<br>30 to 40<br>31 to 37<br>20 to 30 | 20 to 40<br>23 to 40<br>20 to 37<br>20 to 38<br>22 to 38 | 20 to 40<br>23 to 40<br>20 to 37<br>22 to 38 | 12 to 15<br>15 to 18<br>>18 |
| origin z-axis coordinate (mm) | −5 to 0<br>−6 to 1 | −5 to 0<br>−6 to 1 | −5 to 0<br>−6 to 1 | −5 to 0<br>−6 to 1 |

F. HEAD GEOMETRY AND WEIGHT CHARACTERISTICS

1. Loft and Lie

According to some embodiments of the present application, a golf club head has a loft angle between about 6 degrees and about 16 degrees or between about 13 degrees and about 30 degrees. In yet other embodiments, the golf club has a lie angle between about 55 degrees and about 65 degrees.

2. Coefficient of Restitution

Generally, a coefficient of restitution (COR) of a golf club head is the measurement of the amount of energy transferred between a golf club face plate and a ball at impact. In a simplified form, the COR may be expressed as a percentage of the speed of a golf ball immediately after being struck by the club head divided by the speed of the club head upon impact with the golf ball, with the measurement of the golf ball speed and club head speed governed by United States Golf Association guidelines. In some embodiments of the present application, the golf club head has a COR greater than about 0.8.

3. Thin Wall Construction

According to some embodiments of a golf club head of the present application, the golf club head has a thin wall construction. Among other advantages, thin wall construction facilitates the redistribution of material from one part of a club head to another part of the club head. Because the redistributed material has a certain mass, the material may be redistributed to locations in the golf club head to enhance performance parameters related to mass distribution, such as CG location and moment of inertia magnitude. Club head material that is capable of being redistributed without affecting the structural integrity of the club head is commonly called discretionary weight. In some embodiments of the present invention, thin wall construction enables discretionary weight to be removed from one or a combination of the striking plate, crown, skirt, or sole and redistributed in the form of weight ports and corresponding weights.

Thin wall construction can include a thin sole construction, i.e., a sole with a thickness less than about 0.9 mm but greater than about 0.4 mm over at least about 50% of the sole surface area; and/or a thin skirt construction, i.e., a skirt with a thickness less than about 0.8 mm but greater than about 0.4 mm over at least about 50% of the skirt surface area; and/or a thin crown construction, i.e., a crown with a thickness less than about 0.8 mm but greater than about 0.4 mm over at least about 50% of the crown surface area. More specifically, in certain embodiments of a golf club having a thin sole construction and at least one weight and two weight ports, the sole, crown and skirt can have respective thicknesses over at least about 50% of their respective surfaces between about 0.4 mm and about 0.9 mm, between about 0.8 mm and about 0.9 mm, between about 0.7 mm and about 0.8 mm, between about 0.6 mm and about 0.7 mm, or less than about 0.6 mm. According to a specific embodiment of a golf club having a thin skirt construction, the thickness of the skirt over at least about 50% of the skirt surface area can be between about 0.4 mm and about 0.8 mm, between about 0.6 mm and about 0.7 mm or less than about 0.6 mm.

4. Face Plate Geometries

A height and a width can be defined for the face plate of the golf club head. According to some embodiments and as shown in FIG. 17, a face plate 148 has a height 178 measured from a lowermost point of the face plate to an uppermost point of the face plate, and a width 180 measured from a point on the face plate proximate the heel portion 152 to a point on the face plate proximate a toe portion 154, when the golf club is ideally positioned at address.

For example, in some embodiments of a fairway wood-type golf club head of the present application, the golf club head face plate has a height between about 32 mm and about 38 mm and a width between about 86 mm and about 92 mm. More specifically, a particular embodiment of a fairway wood-type golf club head has a face plate height between about 34 mm and about 36 mm and a width between about 88 mm and about 90 mm. In yet a more specific embodiment of a fairway wood-type golf club head, the face plate height is about 35 mm and the width is about 89 mm.

In some embodiments of a driver type golf club head of the present application, the golf club head face plate has a height between about 53 mm and about 59 mm and a width between about 105 mm and about 111 mm. More specifically, a particular embodiment of a driver type golf club head has a face plate height between about 55 mm and about 57 mm and a width between about 107 mm and about 109 mm. In yet a more specific embodiment of a driver type golf club head, the face plate height is about 56 mm and the width is about 108 mm.

Figure 18:
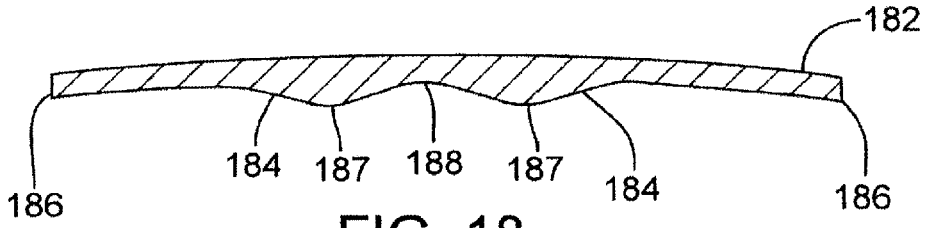
FIG. 18 is a cross-sectional view of a golf club head face plate protrusion.
Figure 19:
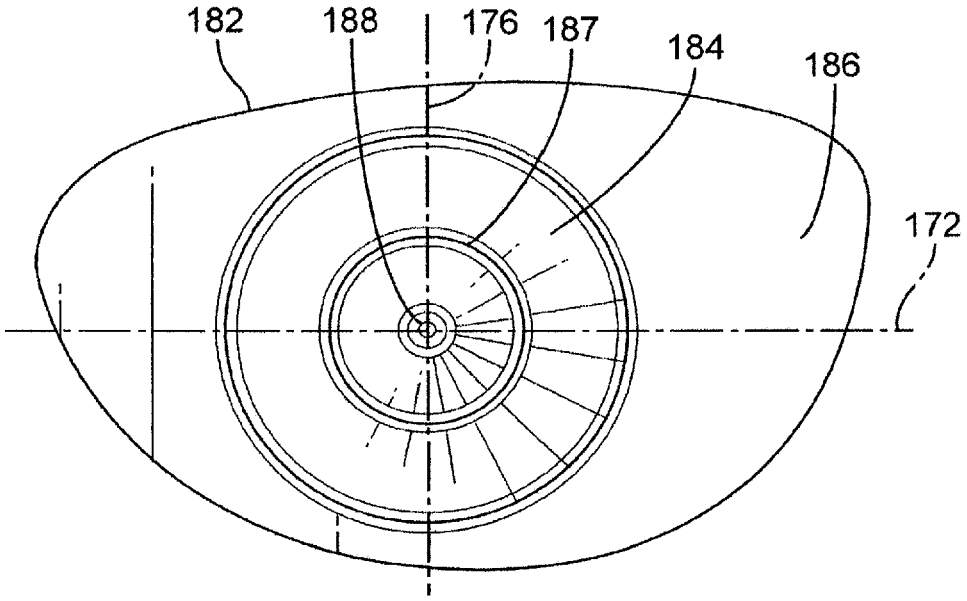
FIG. 19 is a top view of a golf club face plate protrusion.

According to some embodiments, a golf club head face plate can include a variable thickness faceplate. Varying the thickness of a faceplate may increase the size of a club head COR zone, commonly called the sweet spot of the golf club head, which, when striking a golf ball with the golf club head, allows a larger area of the face plate to deliver consistently high golf ball velocity and shot forgiveness. A variable thickness face plate 182, according to one embodiment of a golf club head illustrated in FIGS. 18 and 19, includes a generally circular protrusion 184 extending into the interior cavity towards the rear portion of the golf club head. When viewed in cross-section, as illustrated in FIG. 18, protrusion 184 includes a portion with increasing thickness from an outer portion 186 of the face plate 182 to an intermediate portion 187. The protrusion 184 further includes a portion with decreasing thickness from the intermediate portion 187 to an inner portion 188 positioned approximately at a center of the protrusion preferably proximate the golf club head origin.

In some embodiments of a golf club head having a face plate with a protrusion, the maximum face plate thickness is greater than about 4.8 mm, and the minimum face plate thickness is less than about 2.3 mm. In certain embodiments, the maximum face plate thickness is between about 5 mm and about 5.4 mm and the minimum face plate thickness is between about 1.8 mm and about 2.2 mm. In yet more particular embodiments, the maximum face plate thickness is about 5.2 mm and the minimum face plate thickness is about 2 mm.

In some embodiments of a golf club head having a face plate with a protrusion and a thin sole construction or a thin skirt construction, the maximum face plate thickness is greater than about 3.0 mm and the minimum face plate thickness is less than about 3.0 mm. In certain embodiments, the maximum face plate thickness is between about 3.0 mm and about 4.0 mm, between about 4.0 mm and about 5.0 mm, between about 5.0 mm and about 6.0 mm or greater than about 6.0 mm, and the minimum face plate thickness is between about 2.5 mm and about 3.0 mm, between about 2.0 mm and about 2.5 mm, between about 1.5 mm and about 2.0 mm or less than about 1.5 mm.

For some embodiments of a golf club head of the present application, a ratio of the minimum face plate thickness to the maximum face plate thickness is less than about 0.4. In more specific embodiments, the ratio is between about 0.36 and about 0.39. In yet more certain embodiments, the ratio is about 0.38.

For some embodiments of a fairway wood-type golf club head of the present application, an aspect ratio, (i.e., the ratio of the face plate height to the face plate width) is between about 0.35 and about 0.45. In more specific embodiments, the aspect ratio is between about 0.38 and about 0.42, or about 0.4. For some embodiments of a driver type golf club head of the present application, the aspect ratio is between about 0.45 and about 0.58. In more specific embodiments, the aspect ratio is between about 0.49 and about 0.54, or about 0.52.

G. MASS RATIOS/CONSTRAINTS

1. Ratio of Total Weight Port Mass to Body Mass

According to some embodiments of the golf club head 136 having two weight ports 138 and either one weight 137 or two weights 137, a ratio of the total weight port mass to the body mass is between about 0.08 and about 2.0. According to some specific embodiments, the ratio can be between about 0.08 and about 0.1, between about 0.1 and about 0.17, between about 0.17 and about 0.24, between about 0.24 and about 0.3 or between about 0.3 and about 2.0.

In some embodiments of the golf club head 130 having three weight ports 132 and three weights 131, the ratio of the total weight port mass to the body mass is between about 0.015 and about 0.82. In specific embodiments, the ratio is between about 0.015 and about 0.22, between about 0.22 and about 0.42, between about 0.42 and about 0.62 or between about 0.62 and about 0.82.

In some embodiments of the golf club head 28 having four weight ports 96, 98, 102, 104 and four weights 24, the ratio of the total weight port mass to the body mass is between about 0.019 and about 0.3. In specific embodiments, the ratio is between about 0.019 and about 0.09, between about 0.09 and about 0.16, between about 0.16 and about 0.23 or between about 0.23 and about 0.3.

2. Ratio of Total Weight Port Mass Plus Total Weight Mass to Body Mass

According to some embodiments of the golf club head 136 having two weight ports 138 and one weight 137 or two weights 137, a ratio of the total weight port mass plus the total weight mass to the body mass is between about 0.06 and about 3.0. More specifically, according to certain embodiments, the ratio can be between about 0.06 and about 0.3, between about 0.3 and about 0.6, between about 0.6 and about 0.9, between about 0.9 and about 1.2 or between about 1.2 and about 3.0.

In some embodiments of the golf club head 130 having three weight ports 132 and three weights 131, the ratio of the total weight port mass plus the total weight mass to the body mass is between about 0.044 and about 3.1. In specific embodiments, the ratio is between about 0.044 and about 0.8, between about 0.8 and about 1.6, between about 1.6 and about 2.3 or between about 2.3 and about 3.1.

In some embodiments of the golf club head 28 having four weight ports 96, 98, 102, 104 and four weights 24, the ratio of the total weight port mass plus the total weight mass to the body mass is between about 0.049 and about 4.6. In specific embodiments, the ratio is between about 0.049 and about 1.2, between about 1.2 and about 2.3, between about 2.3 and about 3.5 or between about 3.5 and about 4.6.

3. Product of Total Weight Mass and Separation Distance

In some embodiments of the golf club head 136 having two weight ports 138 and one weight 137, the weight mass multiplied by the separation distance of the weight is between about 50 g·mm and about 15,000 g·mm. More specifically, in certain embodiments, the weight mass multiplied by the weight separation distance is between about 50 g·mm and about 500 g·mm, between about 500 g·mm and about 2,000 g·mm, between about 2,000 g·mm and about 5,000 g·mm or between about 5,000 g·mm and about 15,000 g·mm.

4. Product of Maximum Weight Mass Minus Minimum Weight Mass and Distance Between Maximum and Minimum Weights In some embodiments of a golf club head of the present application having two, three or four weights, a maximum weight mass minus a minimum weight mass multiplied by the distance between the maximum weight and the minimum weight is between about 950 g·mm and about 14,250 g·mm. More specifically, in certain embodiments, the weight mass multiplied by the weight separation distance is between about 950 g·mm and about 4,235 g·mm, between about 4,235 g·mm and about 7,600 g·mm, between about 7,600 g·mm and about 10,925 g·mm or between about 10,925 g·mm and about 14,250 g·mm.

5. Ratio of Total Weight Mass to Sum of Body Mass and Total Weight Port Mass

According to some embodiments of a golf club head having at least one weight and at least two weight ports, a ratio of the total weight mass to the sum of the body mass plus the total weight port mass is between about 0.05 and about 1.25. In specific embodiments, the ratio is between about 0.05 and about 0.35, between about 0.35 and about 0.65, between about 0.65 and about 0.95 or between about 0.95 and about 1.25.

H. SOLE, CROWN AND SKIRT AREAL WEIGHTS

According to some embodiments of a golf club head of the present application, an areal weight, i.e., material density multiplied by the material thickness, of the golf club head sole, crown and skirt, respectively, is less than about 0.45 g/cm$^2$ over at least about 50% of the surface area of the respective sole, crown and skirt. In some specific embodiments, the areal weight is between about 0.15 g/cm$^2$ and about 0.25 g/cm$^2$, between about 0.25 g/cm$^2$ and about 0.35 g/cm$^2$ or between about 0.35 g/cm$^2$ and about 0.45 g/cm$^2$.

According to some embodiments of a golf club having a skirt thickness less than about 0.8 mm, the head skirt areal weight is less than about 0.41 g/cm$^2$ over at least about 50% of the surface area of the skirt. In specific embodiments, the skirt areal weight is between about 0.15 g/cm$^2$ and about 0.24 g/cm$^2$, between about 0.24 g/cm$^2$ and about 0.33 g/cm$^2$ or between about 0.33 g/cm$^2$ and about 0.41 g/cm$^2$.

I. EXAMPLES

1. Example A

According to one embodiment, a golf club head has two ports and at least one weight. The weight has a head origin x-axis coordinate between about −20 mm and about 20 mm and a mass between about 5 grams and about 50 grams. The golf club head has a volume between about 180 cm$^3$ and about 600 cm$^3$, and a CG with a head origin y-axis coordinate greater than or equal to about 15 mm. In a specific embodiment, the weight has a head origin y-axis coordinate between about 0 mm and about 20 mm, between about 20 mm and about 50 mm, or greater than 50 mm. In a specific embodiment, the golf club head has a CG with a head origin x-axis coordinate between about −10 mm and about 10 mm and a y-axis coordinate less than or equal to about 50 mm. In a more specific embodiment, the golf club head has a moment of inertia about the head CG x-axis between about 140 kg·mm$^2$ and about 400 kg·mm$^2$, and a moment of inertia about the head CG z-axis between about 250 kg·mm$^2$ and about 600 kg·mm$^2$.

2. Example B

According to another embodiment, a golf club head has first and second ports and corresponding first and second weights disposed in the ports. The first weight has a head origin x-axis coordinate between about −60 mm and about 0 mm and a mass between about 1 gram and about 100 grams. The second weight has a head origin x-axis coordinate between about 0 mm and about 60 mm and a mass between about 1 gram and about 100 grams. The golf club head has a volume between about 180 cm$^3$ and about 600 cm$^3$, and a CG with a head origin y-axis coordinate greater than or equal to about 15 mm. In a specific embodiment, the first and second weights each have a head origin y-axis coordinate between about 0 mm and about 130 mm. In a specific embodiment, the golf club head has a CG with a head origin x-axis coordinate between about −10 mm and about 10 mm and a y-axis coordinate between about 15 mm to about 25 mm, or between about 25 mm to about 35 mm, or between about 35 mm to about 50 mm. In a more specific embodiment, the golf club head has a moment of inertia about the head CG x-axis between about 140 kg·mm$^2$ and about 400 kg·mm$^2$, a moment of inertia about the head CG z-axis between about 250 kg·mm$^2$ and about 600 kg·mm$^2$, and a head volume greater than or equal to 250 cm$^3$.

3. Example C

According to another embodiment, a golf club head has two ports and at least one weight. The weight has a head origin x-axis coordinate between about −40 mm and about −20 mm or between about 20 mm and about 40 mm, and a mass between about 5 grams and about 50 grams. The golf club head has a volume between about 180 cm$^3$ and about 600 $cm^3$, and a CG with a head origin y-axis coordinate greater than or equal to about 15 mm. In a specific embodiment, the weight has a head origin y-axis coordinate between about 0 mm and about 20 mm, between about 20 mm and about 50 mm, or greater than 50 mm. In a specific embodiment, the golf club head has a CG with a head origin x-axis coordinate between about −10 mm and about 10 mm and a y-axis coordinate less than or equal to about 50 mm. In a more specific embodiment, the golf club head has a moment of inertia about the head CG x-axis between about 140 kg·$mm^2$ and about 400 kg·$mm^2$, and a moment of inertia about the head CG z-axis between about 250 kg·$mm^2$ and about 600 kg·$mm^2$.

4. Example D

According to another embodiment, a golf club head has two ports and at least one weight. The weight has a head origin x-axis coordinate between about −60 mm and about −40 mm or between about 40 mm and about 60 mm, and a mass between about 5 grams and about 50 grams. The golf club head has a volume between about 180 $cm^3$ and about 600 $cm^3$, and a CG with a head origin y-axis coordinate greater than or equal to about 15 mm. In a specific embodiment, the weight has a y-axis coordinate between about 0 mm and about 20 mm, between about 20 mm and about 50 mm, or greater than 50 mm. In a specific embodiment, the golf club head has a CG with a head origin x-axis coordinate between about −10 mm and about 10 mm and a y-axis coordinate less than or equal to about 50 mm. In a more specific embodiment, the golf club head has a moment of inertia about the head CG x-axis between about 140 kg·$mm^2$ and about 400 kg·$mm^2$, and a moment of inertia about the head CG z-axis between about 250 kg·$mm^2$ and about 600 kg·$mm^2$.

5. Example E

According to another embodiment, a golf club head has first and second ports and corresponding first and second weights disposed in the ports. The first weight has a head origin x-axis coordinate between about −52 mm and about −12 mm, a head origin y-axis coordinate between about 36 mm and about 76 mm, and a mass between about 6 grams and about 18 grams. The second weight has a head origin x-axis coordinate between about 10 mm and about 50 mm, a head origin y-axis coordinate between about 36 mm and about 76 mm, and a mass between about 1 gram and about 3 grams. The golf club head has a CG with a head origin x-axis coordinate between about −3 mm and about 2 mm and a head origin y-axis coordinate between about 30 mm and about 40 mm. In a specific embodiment, the golf club head has a volume between about 400 $cm^3$ and about 500 $cm^3$, and the sum of the body mass and the total port mass is between about 180 grams and about 215 grams. In a more specific embodiment, the golf club head has a moment of inertia about the head CG x-axis between about 220 kg·$mm^2$ and about 360 kg·$mm^2$ and a moment of inertia about the head CG z-axis between about 360 kg·$mm^2$ and about 500 kg·$mm^2$.

6. Example F

According to another embodiment, a golf club head has first and second ports and corresponding first and second weights disposed in the ports. The first weight has a head origin x-axis coordinate between about −52 mm and about −12 mm, a head origin y-axis coordinate between about 36 mm and about 76 mm, and a mass between about 1 gram and about 3 grams. The second weight has a head origin x-axis coordinate between about 10 mm and about 50 mm, a head origin y-axis coordinate between about 36 mm and about 76 mm, and a mass between about 6 gram and about 18 grams. The golf club head has a CG with a head origin x-axis coordinate between about 2 mm and about 6 mm and a head origin y-axis coordinate between about 30 mm and about 40 mm. In a specific embodiment, the golf club head has a volume between about 400 $cm^3$ and about 500 $cm^3$, and the sum of the body mass and the total port mass is between about 180 grams and about 215 grams. In a more specific embodiment, the golf club head has a moment of inertia about the head CG x-axis between about 220 kg·$mm^2$ and about 360 kg·$mm^2$ and a moment of inertia about the head CG z-axis between about 360 kg·$mm^2$ and about 500 kg·$mm^2$.

7. Example G

According to another embodiment, a golf club head has first and second ports and corresponding first and second weights disposed in the ports. The first weight has a head origin x-axis coordinate between about −42 mm and about −22 mm, a head origin y-axis coordinate between about 46 mm and about 66 mm, and a mass between about 6 grams and about 18 grams. The second weight has a head origin x-axis coordinate between about 20 mm and about 40 mm, a head origin y-axis coordinate between about 46 mm and about 66 mm, and a mass between about 1 gram and about 3 grams. The golf club head has a CG with a head origin x-axis coordinate between about −2 mm and about 1 mm and a head origin y-axis coordinate between about 31 mm and about 37 mm. In a specific embodiment, the golf club head has a volume between about 440 $cm^3$ and about 460 $cm^3$, and the sum of the body mass and the total port mass is between about 180 grams and about 215 grams. In a more specific embodiment, the golf club head has a moment of inertia about the head CG x-axis between about 220 kg·$mm^2$ and about 280 kg·$mm^2$ and a moment of inertia about the head CG z-axis between about 360 kg·$mm^2$ and about 450 kg·$mm^2$.

8. Example H

According to another embodiment, a golf club head has first and second ports and corresponding first and second weights disposed in the ports. The first weight has a head origin x-axis coordinate between about −42 mm and about −22 mm, a head origin y-axis coordinate between about 46 mm and about 66 mm, and a mass between about 1 gram and about 3 grams. The second weight has a head origin x-axis coordinate between about 20 mm and about 40 mm, a head origin y-axis coordinate between about 46 mm and about 66 mm, and a mass between about 6 grams and about 18 grams. The golf club head has a CG with a head origin x-axis coordinate between about 2 mm and about 5 mm and a head origin y-axis coordinate between about 31 mm and about 37 mm. In a specific embodiment, the golf club head has a volume between about 440 $cm^3$ and about 460 $cm^3$, and the sum of the body mass and the total port mass is between about 180 grams and about 215 grams. In a more specific embodiment, the golf club head has a moment of inertia about the head CG x-axis between about 220 kg·$mm^2$ and about 280 kg·mm$^2$ and a moment of inertia about the head CG z-axis between about 360 kg·mm$^2$ and about 450 kg·mm$^2$.

9. Example I

According to another embodiment, a golf club head has first and second ports and corresponding first and second weights disposed in the ports. The first weight has a head origin x-axis coordinate between about −50 mm and about −10 mm, a head origin y-axis coordinate between about 20 mm and about 50 mm, and a mass between about 6 grams and about 18 grams. The second weight has a head origin x-axis coordinate between about 7 mm and about 42 mm, a head origin y-axis coordinate between about 20 mm and about 50 mm, and a mass between about 1 gram and about 3 grams. The golf club head has a CG with a head origin x-axis coordinate between about −4 mm and about 4 mm and a head origin y-axis coordinate between about 20 mm and about 30 mm. In a specific embodiment, the golf club head has a volume between about 110 cm$^3$ and about 210 cm$^3$, a loft between about 13 degrees and about 30 degrees, and the sum of the body mass and the total port mass is between about 198 grams and about 222 grams. In a more specific embodiment, the golf club head has a moment of inertia about the head CG x-axis between about 70 kg·mm$^2$ and about 140 kg·mm$^2$ and a moment of inertia about the head CG z-axis between about 200 kg·mm$^2$ and about 350 kg·mm$^2$.

10. Example J

According to another embodiment, a golf club head has first and second ports and corresponding first and second weights disposed in the ports. The first weight has a head origin x-axis coordinate between about −50 mm and about −10 mm, a head origin y-axis coordinate between about 20 mm and about 50 mm, and a mass between about 1 gram and about 3 grams. The second weight has a head origin x-axis coordinate between about 7 mm and about 42 mm, a head origin y-axis coordinate between about 20 mm and about 50 mm, and a mass between about 6 grams and about 18 grams. The golf club head has a CG with a head origin x-axis coordinate between about −2 mm and about 6 mm and a head origin y-axis coordinate between about 20 mm and about 30 mm. In a specific embodiment, the golf club head has a volume between about 110 cm$^3$ and about 210 cm$^3$, a loft between about 13 degrees and about 30 degrees, and the sum of the body mass and the total port mass is between about 198 grams and about 222 grams. In a more specific embodiment, the golf club head has a moment of inertia about the head CG x-axis between about 70 kg·mm$^2$ and about 140 kg·mm$^2$ and a moment of inertia about the head CG z-axis between about 200 kg·mm$^2$ and about 350 kg·mm$^2$.

11. Example K

According to another embodiment, a golf club head has first and second ports and corresponding first and second weights disposed in the ports. The first weight has a head origin x-axis coordinate between about −40 mm and about −20 mm, a head origin y-axis coordinate between about 20 mm and about 40 mm, and a mass between about 6 grams and about 18 grams. The second weight has a head origin x-axis coordinate between about 12 mm and about 32 mm, a head origin y-axis coordinate between about 20 mm and about 40 mm, and a mass between about 1 gram and about 3 grams. The golf club head has a CG with a head origin x-axis coordinate between about −4 mm and about 4 mm and a head origin y-axis coordinate between about 20 mm and about 30 mm. In a specific embodiment, the golf club head has a volume between about 110 cm$^3$ and about 210 cm$^3$, a loft between about 13 degrees and about 30 degrees, and the sum of the body mass and the total port mass is between about 198 grams and about 222 grams. In a more specific embodiment, the golf club head has a moment of inertia about the head CG x-axis between about 70 kg·mm$^2$ and about 140 kg·mm$^2$ and a moment of inertia about the head CG z-axis between about 200 kg·mm$^2$ and about 350 kg·mm$^2$.

12. Example L

According to another embodiment, a golf club head has first and second ports and corresponding first and second weights disposed in the ports. The first weight has a head origin x-axis coordinate between about −40 mm and about −20 mm, a head origin y-axis coordinate between about 20 mm and about 40 mm, and a mass between about 1 gram and about 3 grams. The second weight has a head origin x-axis coordinate between about 12 mm and about 32 mm, a head origin y-axis coordinate between about 20 mm and about 40 mm, and a mass between about 6 grams and about 18 grams. The golf club head has a CG with a head origin x-axis coordinate between about −2 mm and about 6 mm and a head origin y-axis coordinate between about 20 mm and about 30 mm. In a specific embodiment, the golf club head has a volume between about 110 cm$^3$ and about 210 cm$^3$, a loft between about 13 degrees and about 30 degrees, and the sum of the body mass and the total port mass is between about 198 grams and about 222 grams. In a more specific embodiment, the golf club head has a moment of inertia about the head CG x-axis between about 70 kg·mm$^2$ and about 140 kg·mm$^2$ and a moment of inertia about the head CG z-axis between about 200 kg·mm$^2$ and about 350 kg·mm$^2$.

13. Example M

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 1 gram and about 3 grams. The second weight has a head origin x-axis coordinate between about −30 mm and about −10 mm, a head origin y-axis coordinate between about 63 mm and about 83 mm, and a mass between about 6 grams and about 18 grams. The third weight has a head origin x-axis coordinate between about 24 mm and about 44 mm, a head origin y-axis coordinate between about 10 mm and about 30 mm, and a mass between about 1 gram and about 3 grams. The golf club head has a CG with a head origin x-axis coordinate between about −1 mm and about 4 mm and a head origin y-axis coordinate between about 23 mm and about 40 mm. In a specific embodiment, the golf club head has a volume between about 360 cm$^3$ and about 460 cm$^3$ and the sum of the body mass and the total port mass is between about 191 grams and about 211 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

14. Example N

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 6 grams and about 18 grams. The second weight has a head origin x-axis coordinate between about −30 mm and about −10 mm, a head origin y-axis coordinate between about 63 mm and about 83 mm, and a mass between about 1 gram and about 3 grams. The third weight has a head origin x-axis coordinate between about 24 mm and about 44 mm, a head origin y-axis coordinate between about 10 mm and about 30 mm, and a mass between about 6 grams and about 18 grams. The golf club head has a CG with a head origin x-axis coordinate between about −1 mm and about 4 mm and a head origin y-axis coordinate between about 20 mm and about 37 mm. In a specific embodiment, the golf club head has a volume between about 360 cm$^3$ and about 460 cm$^3$ and the sum of the body mass and the total port mass is between about 191 grams and about 211 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

15. Example O

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 6 grams and about 18 grams. The second weight has a head origin x-axis coordinate between about −30 mm and about −10 mm, a head origin y-axis coordinate between about 63 mm and about 83 mm, and a mass between about 1 gram and about 3 grams. The third weight has a head origin x-axis coordinate between about 24 mm and about 44 mm, a head origin y-axis coordinate between about 10 mm and about 30 mm, and a mass between about 1 gram and about 3 grams. The golf club head has a CG with a head origin x-axis coordinate between about −3 mm and about 3 mm and a head origin y-axis coordinate between about 20 mm and about 38 mm. In a specific embodiment, the golf club head has a volume between about 360 cm$^3$ and about 460 cm$^3$ and the sum of the body mass and the total port mass is between about 191 grams and about 211 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

16. Example P

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 1 gram and about 3 grams. The second weight has a head origin x-axis coordinate between about −30 mm and about −10 mm, a head origin y-axis coordinate between about 63 mm and about 83 mm, and a mass between about 6 grams and about 18 grams. The third weight has a head origin x-axis coordinate between about 24 mm and about 44 mm, a head origin y-axis coordinate between about 10 mm and about 30 mm, and a mass between about 6 grams and about 18 grams. The golf club head has a CG with a head origin x-axis coordinate between about 0 mm and about 6 mm and a head origin y-axis coordinate between about 22 mm and about 38 mm. In a specific embodiment, the golf club head has a volume between about 360 cm$^3$ and about 460 cm$^3$ and the sum of the body mass and the total port mass is between about 191 grams and about 211 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

17. Example Q

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 1 gram and about 3 grams. The second weight has a head origin x-axis coordinate between about −30 mm and about −10 mm, a head origin y-axis coordinate between about 63 mm and about 83 mm, and a mass between about 1 gram and about 3 grams. The third weight has a head origin x-axis coordinate between about 24 mm and about 44 mm, a head origin y-axis coordinate between about 10 mm and about 30 mm, and a mass between about 6 grams and about 18 grams. The golf club head has a CG with a head origin x-axis coordinate between about 0 mm and about 6 mm and a head origin y-axis coordinate between about 20 mm and about 38 mm. In a specific embodiment, the golf club head has a volume between about 360 cm$^3$ and about 460 cm$^3$ and the sum of the body mass and the total port mass is between about 191 grams and about 211 grams. In a more specific embodiment, the golf club head has a moment of inertia about the head CG x-axis between about 180 kg·mm$^2$ and about 280 kg·mm$^2$ and a moment of inertia about the head CG z-axis between about 300 kg·mm$^2$ and about 450 kg·mm$^2$.

18. Example R

According to another embodiment, a golf club head has first, second, and third ports and corresponding first, second, and third weights disposed in the ports. The first weight has a head origin x-axis coordinate between about −47 mm and about −27 mm, a head origin y-axis coordinate between about 10 mm and about 30 mm, and a mass between about 6 grams and about 18 grams. The second weight has a head origin x-axis coordinate between about −30 mm and about −10 mm, a head origin y-axis coordinate between about 63 mm and about 83 mm, and a mass between about 6 grams and about 18 grams. The third weight has a head origin x-axis coordinate between about 24 mm and about 44 mm, a head origin y-axis coordinate between about 10 mm and about 30 mm, and a mass between about 1 gram and about 3 grams. The golf club head has a CG with a head origin x-axis coordinate between about −3 mm and about 3 mm and a head origin y-axis coordinate between about 22 mm and about 38 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

19. Example S

According to another embodiment, a golf club head has first, second, third, and fourth ports and corresponding first, second, third, and fourth weights disposed in the ports. The first weight has a head origin x-axis coordinate between about −47 mm and about −27 mm, a head origin y-axis coordinate between about 10 mm and about 30 mm, and a mass between about 1 gram and about 3 grams. The second weight has a head origin x-axis coordinate between about −30 mm and about −10 mm, a head origin y-axis coordinate between about 63 mm and about 83 mm, and a mass between about 6 grams and about 18 grams. The third weight has a head origin x-axis coordinate between about 8 mm and about 28 mm, a head origin y-axis coordinate between about 63 mm and about 83 mm, and a mass between about 6 grams and about 18 grams. The fourth weight has a head origin x-axis coordinate between about 24 mm and about 44 mm, a head origin y-axis coordinate between about 10 mm and about 30 mm, and a mass between about 1 gram and about 3 grams. The golf club head has a CG with a head origin x-axis coordinate between about −1 mm and about 4 mm and a head origin y-axis coordinate between about 23 mm and about 40 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

20. Example T

According to another embodiment, a golf club head has first, second, third, and fourth ports and corresponding first, second, third, and fourth weights disposed in the ports. The first weight has a head origin x-axis coordinate between about −47 mm and about −27 mm, a head origin y-axis coordinate between about 10 mm and about 30 mm, and a mass between about 6 grams and about 18 grams. The second weight has a head origin x-axis coordinate between about −30 mm and about −10 mm, a head origin y-axis coordinate between about 63 mm and about 83 mm, and a mass between about 1 gram and about 3 grams. The third weight has a head origin x-axis coordinate between about 8 mm and about 28 mm, a head origin y-axis coordinate between about 63 mm and about 83 mm, and a mass between about 1 gram and about 3 grams. The fourth weight has a head origin x-axis coordinate between about 24 mm and about 44 mm, a head origin y-axis coordinate between about 10 mm and about 30 mm, and a mass between about 6 grams and about 18 grams. The golf club head has a CG with a head origin x-axis coordinate between about −1 mm and about 4 mm and a head origin y-axis coordinate between about 20 mm and about 37 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

21. Example U

According to another embodiment, a golf club head has first, second, third, and fourth ports and corresponding first, second, third, and fourth weights disposed in the ports. The first weight has a head origin x-axis coordinate between about −47 mm and about −27 mm, a head origin y-axis coordinate between about 10 mm and about 30 mm, and a mass between about 6 grams and about 18 grams. The second weight has a head origin x-axis coordinate between about −30 mm and about −10 mm, a head origin y-axis coordinate between about 63 mm and about 83 mm, and a mass between about 6 grams and about 18 grams. The third weight has a head origin x-axis coordinate between about 8 mm and about 28 mm, a head origin y-axis coordinate between about 63 mm and about 83 mm, and a mass between about 1 gram and about 3 grams. The fourth weight has a head origin x-axis coordinate between about 24 mm and about 44 mm, a head origin y-axis coordinate between about 10 mm and about 30 mm, and a mass between about 1 gram and about 3 grams. The golf club head has a CG with a head origin x-axis coordinate between about −3 mm and about 3 mm and a head origin y-axis coordinate between about 22 mm and about 38 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

22. Example V

According to another embodiment, a golf club head has first, second, third, and fourth ports and corresponding first, second, third, and fourth weights disposed in the ports. The first weight has a head origin x-axis coordinate between about −47 mm and about −27 mm, a head origin y-axis coordinate between about 10 mm and about 30 mm, and a mass between about 1 gram and about 3 grams. The second weight has a head origin x-axis coordinate between about −30 mm and about −10 mm, a head origin y-axis coordinate between about 63 mm and about 83 mm, and a mass between about 1 gram and about 3 grams. The third weight has a head origin x-axis coordinate between about 8 mm and about 28 mm, a head origin y-axis coordinate between about 63 mm and about 83 mm, and a mass between about 6 grams and about 18 grams. The fourth weight has a head origin x-axis coordinate between about 24 mm and about 44 mm, a head origin y-axis coordinate between about 10 mm and about 30 mm, and a mass between about 6 grams and about 18 grams.

The golf club head has a CG with a head origin x-axis coordinate between about 0 mm and about 6 mm and a head origin y-axis coordinate between about 22 mm and about 38 mm. In a specific embodiment, the golf club head has a volume between about 360 $cm^3$ and about 460 $cm^3$ and the sum of the body mass and the total port mass is between about 191 grams and about 211 grams. In a more specific embodiment, the golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$.

23. Example W

According to another embodiment, the sole, skirt, crown, and faceplate of a golf club head are each formed from a titanium alloy. The sole has a thickness less than about 0.9 mm but greater than about 0.4 mm over at least 50% of the sole surface area; the skirt has a thickness less than about 0.8 mm but greater than 0.4 mm over at least 50% of the skirt surface area; and the crown has a thickness less than about 0.8 mm but greater than about 0.4 mm over at least 50% of the crown surface area. The areal weight of the sole, crown, and skirt, respectively, is less than about 0.45 $g/cm^2$ over at least 50% of the surface area of the respective sole, crown and skirt. The golf club head has first, second, third, and fourth ports and corresponding first, second, third, and fourth weights disposed in the ports. The first weight has a head origin x-axis coordinate between about −47 mm and about −27 mm, a head origin y-axis coordinate between about 10 mm and about 30 mm, and a mass between about 1 grams and about 18 grams. The second weight has a head origin x-axis coordinate between about −30 mm and about −10 mm, a head origin y-axis coordinate between about 63 mm and about 83 mm, and a mass between about 1 grams and about 18 grams. The third weight has a head origin x-axis coordinate between about 8 mm and about 28 mm, a head origin y-axis coordinate between about 63 mm and about 83 mm, and a mass between about 1 gram and about 18 grams. The fourth weight has a head origin x-axis coordinate between about 24 mm and about 44 mm, a head origin y-axis coordinate between about 10 mm and about 30 mm, and a mass between about 1 gram and about 18 grams. The golf club head has a CG with a head origin x-axis coordinate between about −3 mm and about 6 mm and a head origin y-axis coordinate between about 20 mm and about 40 mm. The golf club head has a volume between about 360 $cm^3$ and about 460 $cm^3$ and the sum of the body mass and the total port mass is between about 191 grams and about 211 grams. The golf club head has a moment of inertia about the head CG x-axis between about 180 $kg \cdot mm^2$ and about 280 $kg \cdot mm^2$ and a moment of inertia about the head CG z-axis between about 300 $kg \cdot mm^2$ and about 450 $kg \cdot mm^2$. The ratio of the golf club head's total weight port volume to the head volume is between about 0.001 and about 0.05, and the angle formed between the weight ports' radial axes and a golf club head impact axis is between about 10 degrees and about 80 degrees. The golf club head has a loft angle between about 6 degrees and about 16 degrees, a lie angle between about 55 degrees and about 65 degrees, and a coefficient of restitution greater than 0.8. The ratio of the golf club head's total weight port mass to the body mass is between about 0.019 and about 0.3, and a maximum weight mass minus a minimum weight mass multiplied by the distance between the maximum weight and the minimum weight is between about 950 g·mm and about 14,250 g·mm. Additionally, a ratio of the golf club head's total weight mass to the sum of the body mass plus the total weight port mass is between about 0.05 and about 1.25.

24. Preferred Embodiment

According to a preferred embodiment, the sole, skirt, crown, and faceplate of a golf club head are each formed from a titanium alloy. The sole has a thickness less than about 0.9 mm but greater than about 0.4 mm over at least 50% of the sole surface area; the skirt has a thickness less than about 0.8 mm but greater than 0.4 mm over at least 50% of the skirt surface area; and the crown has a thickness less than about 0.8 mm but greater than about 0.4 mm over at least 50% of the crown surface area. The areal weight of the sole, crown, and skirt, respectively, is less than about 0.45 $g/cm^2$ over at least 50% of the surface area of the respective sole, crown and skirt. The golf club head has first, second, third, and fourth ports and corresponding first, second, third, and fourth weights disposed in the ports. The first weight has a head origin x-axis coordinate between about −33 mm and about −27 mm, a head origin y-axis coordinate between about 14 mm and about 18 mm, a head origin z-axis coordinate between about −18 mm and about −14 mm, and a mass between about 1 gram and about 18 grams. The second weight has a head origin x-axis coordinate between about 28 mm and about 36 mm, a head origin y-axis coordinate between about 14 mm and about 18 mm, a head origin z-axis coordinate between about −12 mm and about −16 mm, and a mass between about 1 gram and about 18 grams. The third weight has a head origin x-axis coordinate between about 9 mm and about 13 mm, a head origin y-axis coordinate between about 98 mm and about 120 mm, a head origin z-axis coordinate between about 8 mm and about 10 mm, and a mass between about 1 gram and about 18 grams. The fourth weight has a head origin x-axis coordinate between about 9 mm and about 13 mm, a head origin y-axis coordinate between about 98 mm and about 120 mm, a head origin z-axis coordinate between about −21 mm and about −17 mm, and a mass between about 1 gram and about 18 grams. The golf club head has a CG with a head origin x-axis coordinate between about −3 mm and about 6 mm, a head origin y-axis coordinate between about 20 mm and about 40 mm, and a head origin z-axis coordinate between about −6 mm and about 1 mm. The golf club head has a volume between about 360 $cm^3$ and about 460 $cm^3$ and the sum of the body mass and the total port mass is between about 191 grams and about 211 grams. The golf club head has a moment of inertia about the head CG x-axis between about 180 $kg \cdot mm^2$ and about 430 $kg \cdot mm^2$ and a moment of inertia about the head CG z-axis between about 300 $kg \cdot mm^2$ and about 560 $kg \cdot mm^2$. The ratio of the golf club head's total weight port volume to the head volume is between about 0.001 and about 0.05, and the angle formed between the weight ports' radial axes and a golf club head impact axis is between about 10 degrees and about 80 degrees. The golf club head has a loft angle between about 6 degrees and about 16 degrees, a lie angle between about 55 degrees and about 65 degrees, and a coefficient of restitution greater than 0.8. The ratio of the golf club head's total weight port mass to the body mass is between about 0.019 and about 0.3, and a maximum weight mass minus a minimum weight mass multiplied by the distance between the maximum weight and the minimum weight is between about 950 g·mm and about 14,250 g·mm. Additionally, a ratio of the golf club head's total weight mass to the sum of the body mass plus the total weight port mass is between about 0.05 and about 1.25.

Various other designs of club heads and weights may be used, such as those disclosed in Applicant's U.S. Pat. No. 6,773,360 or those disclosed in other related applications. Furthermore, other club head designs known in the art can be adapted to take advantage of features of the present invention. In some disclosed examples, four weight ports are provided, but in other examples, one, two, three, four, or more weight ports can be provided and weight assemblies, weight screws, or other weights can be selected for use in these weight ports. For example, a club head can be provided with weight ports situated at a club toe and a club heel, respectively, and a third weight port situated at or near a club head crown. This weight port at the crown and the associated weights can be configured to adjust a vertical and horizontal location of a club head center of gravity.

In some disclosed examples, vertical adjustment of club head center of gravity permits selection, control, or compensation of "dynamic loft." Dynamic loft is essentially the difference between the effective loft at impact and the static loft angle at address. Dynamic loft can result from, for example, distortions in a club shaft produced by a golfer's swing. Deliberate vertical displacement of the club head center of gravity can result in striking face impact locations that tend to be vertically displaced from a horizontal plane containing a club head center of gravity so that a club head tends to rotate about the club head center-of-gravity (CG) x-axis. Such club head rotations about the CG x-axis tend to change dynamic loft and to produce corresponding vertical ball spins, such as varying degrees of backspin. This induced vertical spin is produced in a manner similar to the horizontal or side spin that results from the so-called "gear effect" produced by horizontal off-center hits. For example, moving a club head center of gravity vertically tends to change the amount of backspin on the launched ball. When a club head center of gravity is located low in a club head, a golf ball tends to impact the head above the center of gravity resulting in a backward or upward rotation of the club head, thereby reducing backspin. Such head rotation also tends to increase dynamic loft by launching the ball at a higher angle than a resting loft angle. When a club head center of gravity is located high in the club head, a golf ball tends to impact the head below the center of gravity, resulting in a downward or forward rotation of the club head. Such rotation tends to increase backspin via the gear effect and to reduce dynamic loft. Moving a club head center of gravity back from the face of the club head tends to increase the gear effect in the vertical and horizontal directions.

Both spin and loft can be associated with ball trajectory and can be adjusted through movement of a club head center of gravity. Through selective vertical and horizontal displacements of a club head center of gravity, ball spin and ball launch angle can be selected independently, and clubs providing dynamic loft adjustments permit players to more fully customize shot characteristics.

For example, spin and launch angle can be decoupled when a club head center of gravity is adjusted simultaneously in horizontal and vertical directions. In some embodiments, adjusting a club head center of gravity to a position in the back of the club head increases dynamic loft. Such an effect can be compensated by also moving the center of gravity upwards, which decreases the launch angle. For representative club head having a volume of 407 $cm^3$ and 21 g of movable weight, about 5 mm of backward (from the face) CG displacement is associated with a launch angle increase of about 0.8 degrees, while launch angle is decreased by about 0.2 degrees for each 1 mm of vertically upwards CG displacement. Thus, approximately 1.25 mm of vertical CG movement coupled with approximately 1.56 mm of horizontal center of gravity movement results in an increase in backspin accompanied by essentially no change in launch angle.

In the disclosed embodiments, three of four weight ports are provided. In one example, three weight ports are arranged in a club sole so as to define a generally isosceles triangle and a fourth weight port is located in the crown. In a typical arrangement with about 21 g of movable weight for distribution in the weight ports, front-to-back CG movement is about 33.5 mm to about 41.5 mm from an approximate center of the face plate. Toe-to-heel CG movement can be about 0.2 mm to about 5.1 mm with respect of face center, and the CG can be displaced from about −0.9 mm below to about 1.7 mm above the face center.

Having illustrated and described the principles of the disclosed embodiments, it will be apparent to those skilled in the art that the embodiments can be modified in arrangement and detail without departing from such principles. In view of the many possible embodiments, it will be recognized that the described embodiments include only examples and should not be taken as a limitation on the scope of the invention. Rather, the invention is defined by the following claims. We therefore claim as the invention all possible embodiments and their equivalents that come within the scope of these claims.

We claim:

1. A wood-type golf club head comprising:

a body comprising a face positioned at a forward portion of the golf club head, a sole positioned at a bottom portion of the golf club head, a crown positioned at a top portion of the golf club head and a skirt positioned around a periphery of the golf club head between the sole and crown, wherein the body defines an interior cavity;

wherein:

the head has a face center positioned on the face at an approximate geometric center of the face, the face center including an x-axis tangential to the face and generally parallel to the ground when the head is ideally positioned, a y-axis generally perpendicular to the x-axis and generally parallel to the ground when the head is ideally positioned, and a z-axis generally perpendicular to the x-axis and to the y-axis and generally perpendicular to the ground when the head is ideally positioned;

a center of gravity of the golf club head is situated at a predetermined head origin y-coordinate on the y-axis that provides dynamic loft, and at a head origin z-coordinate on the z-axis that at least partially compensates for dynamic loft;

at least a portion of the sole comprises a toeward edge, extending to a first rearwardmost point of the sole, and a heelward edge, extending to a second rearwardmost point of the sole;

the toeward edge is substantially linear and the heelward edge is substantially linear; and a first hypothetical line, collinear with the toeward edge, converges with a second hypothetical line, collinear with the heelward edge, at a location rearward of a rearwardmost point of the golf club head; and the golf club head further comprises a weight that is selectively alternatively movable into a heel position on a heelward side of the y-axis, and into a toe position on a toeward side of the y-axis.

2. The golf club head according to claim 1, wherein:

the sole further comprises a rearwardmost edge that extends from the toeward edge, at the first rearwardmost point of the sole, to the heelward edge, at the second rearwardmost point of the sole;

the rearwardmost edge defines a lowermost edge of a rearwardmost surface of the sole; and the rearwardmost surface of the sole is flat.

3. The golf club head according to claim 1, wherein:

the sole further comprises a rearwardmost edge that extends from the toeward edge, at the first rearwardmost point of the sole, to the heelward edge, at the second rearwardmost point of the sole;

the sole further comprises a first corner, at an intersection of the toeward edge and the rearwardmost edge; and the sole further comprises a second corner, at an intersection of the heelward edge and the rearwardmost edge.

4. The golf club head according to claim 1, wherein:

the y-axis is located between the toeward edge and the heelward edge;

the toeward edge is angled toward the y-axis in a forward-to-rearward direction; and the heelward edge is angled toward the y-axis in a forward-to-rearward direction.

5. The golf club head according to claim 4, wherein an angle between the toeward edge and the y-axis is greater than an angle between the heelward edge and the y-axis.

6. The golf club head according to claim 1, wherein a vertical plane bifurcating the sole between the toeward edge and the heelward edge and passing through the face center is angled relative to the y-axis.

7. The golf club head according to claim 1, wherein the at least the portion of the sole is asymmetric about a plane, passing through the y-axis and the z-axis.

8. The golf club head according to claim 1, wherein:

the toeward edge extends rearwardly from a first location, closer to the face than the first rearwardmost point of the sole, to the first rearwardmost point of the sole; and the heelward edge extends rearwardly from a second location, closer to the face than the second rearwardmost point of the sole, to the second rearwardmost point of the sole.

9. The golf club head according to claim 1, wherein:

the sole further comprises a rearwardmost edge that extends from the toeward edge, at the first rearwardmost point of the sole, to the heelward edge, at the second rearwardmost point of the sole;

the rearwardmost edge defines a lowermost edge of a rearwardmost surface of the sole; the rearwardmost surface is below a junction between the crown and the skirt; and the golf club head further comprises a weight located in the rearwardmost surface.

10. The golf club head according to claim 9, wherein the weight is removable from the rearwardmost surface of the sole.

11. The golf club head according to claim 9, wherein the weight is selectively alternatively movable into a first rearward position and a second rearward position that is different than the first rearward position.

12. The golf club head according to claim 1, wherein:

the sole further comprises a rearwardmost edge that extends from the toeward edge, at the first rearwardmost point of the sole, to the heelward edge, at the second rearwardmost point of the sole;

the rearwardmost edge defines a lowermost edge of a rearwardmost surface of the sole; and the rearwardmost surface is substantially parallel with the z-axis.

13. The golf club head according to claim 1, further comprising a plurality of weight ports formed in the body, wherein:

the plurality of weight ports are arranged on the body to selectively receive and retain one or more weights to displace the center of gravity;

a first weight port of the plurality of weight ports has a head origin y-axis coordinate on the y-axis greater than about 80 mm and less than about 130 mm; and a second weight port of the plurality of weight ports is positioned forward of the center gravity and has a negative head origin z-axis coordinate on the z-axis.

14. The golf club head according to claim 1, wherein:

the face has a variable thickness including a maximum face thickness and a minimum face thickness; and the minimum face thickness is between about 1.5 mm and about 2.5 mm and the maximum face thickness is between about 3.0 mm and 4.0 mm.

15. A wood-type golf club head comprising:

a body comprising a face positioned at a forward portion of the golf club head, a sole positioned at a bottom portion of the golf club head, a crown positioned at a top portion of the golf club head and a skirt positioned around a periphery of the golf club head between the sole and crown, wherein the body defines an interior cavity;

wherein:

the head has a face center positioned on the face at an approximate geometric center of the face, the face center including an x-axis tangential to the face and generally parallel to the ground when the head is ideally positioned, a y-axis generally perpendicular to the x-axis and generally parallel to the ground when the head is ideally positioned, and a z-axis generally perpendicular to the x-axis and to the y-axis and generally perpendicular to the ground when the head is ideally positioned;

a center of gravity of the head is situated at a predetermined head origin y-coordinate on the y-axis that provides dynamic loft, and at a head origin z-coordinate on the z-axis that at least partially compensates for dynamic loft;

at least a portion of the sole comprises a toeward edge, extending to a first rearwardmost point of the sole, and a heelward edge, extending to a second rearwardmost point of the sole;

the toeward edge is substantially linear and the heelward edge is substantially linear;

the at least the portion of the sole is asymmetric about a plane, passing through the y-axis and the z-axis;

the sole further comprises a rearwardmost edge that extends from the toeward edge, at the first rearwardmost point of the sole, to the heelward edge, at the second rearwardmost point of the sole;

the rearwardmost edge defines a lowermost edge of a rearwardmost surface of the sole; and the rearwardmost surface is below a junction between the crown and the skirt; and the golf club head further comprises a weight located in the rearwardmost surface.

16. The golf club head according to claim 15, wherein the golf club head further comprises a weight that is selectively alternatively movable into a heel position, on a heelward side of the y-axis, and a toe position, on a toeward side of the y-axis.

17. The golf club head according to claim 15, wherein a vertical plane bifurcating the sole between the toeward edge and the heelward edge and passing through the face center is angled relative to the y-axis.

18. The golf club head according to claim 15, wherein:

the sole further comprises a rearwardmost edge that extends from the toeward edge, at the first rearwardmost point of the sole, to the heelward edge, at the second rearwardmost point of the sole;

the rearwardmost edge defines a lowermost edge of a rearwardmost surface of the sole; and the rearwardmost surface is substantially parallel with the z-axis.

19. A wood-type golf club head comprising:

a body comprising a face positioned at a forward portion of the golf club head, a sole positioned at a bottom portion of the golf club head, a crown positioned at a top portion of the golf club head and a skirt positioned around a periphery of the golf club head between the sole and crown, wherein the body defines an interior cavity;

wherein:

the head has a face center positioned on the face at an approximate geometric center of the face, the face center including an x-axis tangential to the face and generally parallel to the ground when the head is ideally positioned, a y-axis generally perpendicular to the x-axis and generally parallel to the ground when the head is ideally positioned, and a z-axis generally perpendicular to the x-axis and to the y-axis and generally perpendicular to the ground when the head is ideally positioned;

a center of gravity of the golf club head is situated at a predetermined head origin y-coordinate on the y-axis that provides dynamic loft, and at a head origin z-coordinate on the z-axis that at least partially compensates for dynamic loft;

at least a portion of the sole comprises a toeward edge, extending to a first rearwardmost point of the sole, and a heelward edge, extending to a second rearwardmost point of the sole;

the toeward edge is substantially linear and the heelward edge is substantially linear;

a first hypothetical line, collinear with the toeward edge, converges with a second hypothetical line, collinear with the heelward edge, at a location rearward of a rearwardmost point of the golf club head;

the golf club head further comprises a plurality of weight ports formed in the body;

the plurality of weight ports are arranged on the body to selectively receive and retain one or more weights to displace the center of gravity;

a first weight port of the plurality of weight ports has a head origin y-axis coordinate on the y-axis greater than about 80 mm and less than about 130 mm; and a second weight port of the plurality of weight ports is positioned forward of the center gravity and has a negative head origin z-axis coordinate on the z-axis.

20. A wood-type golf club head comprising:

a body comprising a face positioned at a forward portion of the golf club head, a sole positioned at a bottom portion of the golf club head, a crown positioned at a top portion of the golf club head and a skirt positioned around a periphery of the golf club head between the sole and crown, wherein the body defines an interior cavity;

wherein:

the head has a face center positioned on the face at an approximate geometric center of the face, the face center including an x-axis tangential to the face and generally parallel to the ground when the head is ideally positioned, a y-axis generally perpendicular to the x-axis and generally parallel to the ground when the head is ideally positioned, and a z-axis generally perpendicular to the x-axis and to the y-axis and generally perpendicular to the ground when the head is ideally positioned;

a center of gravity of the golf club head is situated at a predetermined head origin y-coordinate on the y-axis that provides dynamic loft, and at a head origin z-coordinate on the z-axis that at least partially compensates for dynamic loft;

at least a portion of the sole comprises a toeward edge, extending to a first rearwardmost point of the sole, and a heelward edge, extending to a second rearwardmost point of the sole;

the toeward edge is substantially linear and the heelward edge is substantially linear;

a first hypothetical line, collinear with the toeward edge, converges with a second hypothetical line, collinear with the heelward edge, at a location rearward of a rearwardmost point of the golf club head; and a vertical plane bifurcating the sole between the toeward edge and the heelward edge and passing through the face center is angled relative to the y-axis.

* * * * *